US011008517B2

(12) United States Patent
Chun et al.

(10) Patent No.: US 11,008,517 B2
(45) **Date of Patent: *May 18, 2021**

(54) NON-PERPENDICULAR CONNECTIONS BETWEEN COKE OVEN UPTAKES AND A HOT COMMON TUNNEL, AND ASSOCIATED SYSTEMS AND METHODS

(71) Applicant: SUNCOKE TECHNOLOGY AND DEVELOPMENT LLC, Lisle, IL (US)

(72) Inventors: Ung-Kyung Chun, Chicago, IL (US); Chun Wai Choi, Chicago, IL (US); Milos Kaplarevic, Chicago, IL (US); Rajat Kapoor, Naperville, IL (US); John Francis Quanci, Haddonfield, NJ (US)

(73) Assignee: SUNCOKE TECHNOLOGY AND DEVELOPMENT LLC, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/026,363

(22) Filed: Jul. 3, 2018

(65) Prior Publication Data

US 2019/0169503 A1 Jun. 6, 2019

Related U.S. Application Data

(63) Continuation of application No. 13/830,971, filed on Mar. 14, 2013, now Pat. No. 10,047,295, which is a (Continued)

(51) Int. Cl.
*C10B 15/02* (2006.01)
*C10B 45/00* (2006.01)

(52) U.S. Cl.
CPC ..... *C10B 15/02* (2013.01); *C10B 45/00* (2013.01)

(58) Field of Classification Search
CPC ..... C10B 15/00; C10B 15/02; C10B 27/00; C10B 27/02; C10B 27/06; C10B 45/00; (Continued)

(56) References Cited

U.S. PATENT DOCUMENTS 425,797 A 4/1890 Hunt
469,868 A 3/1892 Osbourn
(Continued)

FOREIGN PATENT DOCUMENTS

CA 1172895 8/1984
CA 2775992 5/2011
(Continued)

OTHER PUBLICATIONS

Bassett et al., "Calculation of steady flow pressure loss coefficients for pipe junctions", 2001, IMechE, Proc Instn Mech Engrs vol. 215 Part C, p. 861-881. (Year: 2001).*
(Continued)

*Primary Examiner* — Jonathan Luke Pilcher
(74) *Attorney, Agent, or Firm* — Perkins Coie LLP

(57) ABSTRACT

The present technology is generally directed to non-perpendicular connections between coke oven uptakes and a hot common tunnel, and associated systems and methods. In some embodiments, a coking system includes a coke oven and an uptake duct in fluid communication with the coke oven. The uptake duct has an uptake flow vector of exhaust gas from the coke oven. The system also includes a common tunnel in fluid communication with the uptake duct. The common tunnel has a common flow vector and can be configured to transfer the exhaust gas to a venting system. The uptake flow vector and common flow vector can meet at a non-perpendicular interface to improve mixing between the flow vectors and reduce draft loss in the common tunnel.

5 Claims, 15 Drawing Sheets

Related U.S. Application Data continuation-in-part of application No. 13/730,673, filed on Dec. 28, 2012, now Pat. No. 9,476,547.

(58) Field of Classification Search

CPC ..... F15D 1/00; F15D 1/001; F15D 1/0025; F15D 1/02; F15D 1/04; F17D 1/02

See application file for complete search history.

(56) References Cited

U.S. PATENT DOCUMENTS 845,719 A 2/1907 Schniewind
976,580 A 7/1909 Krause
1,140,798 A 5/1915 Carpenter
1,424,777 A 8/1922 Schondeling
1,430,027 A 9/1922 Plantinga
1,486,401 A 3/1924 Van Ackeren
1,530,995 A 3/1925 Geiger
1,572,391 A 2/1926 Klaiber
1,677,973 A 7/1928 Marquard
1,705,039 A 3/1929 Thornhill
1,721,813 A 7/1929 Geipert
1,757,682 A 5/1930 Palm
1,818,370 A 8/1931 Wine
1,818,994 A 8/1931 Kreisinger
1,830,951 A 11/1931 Lovett
1,848,818 A 3/1932 Becker
1,947,499 A 2/1934 Schrader et al.
1,955,962 A 4/1934 Jones
2,075,337 A 3/1937 Burnaugh
2,141,035 A 12/1938 Daniels
2,195,466 A * 4/1940 Otto ..... C10B 27/00 201/26
2,235,970 A 3/1941 Wilputte
2,340,981 A 2/1944 Otto
2,394,173 A 2/1946 Harris et al.
2,424,012 A 7/1947 Bangham et al.
2,609,948 A 9/1952 Laveley
2,641,575 A 6/1953 Otto
2,649,978 A 8/1953 Such
2,667,185 A 1/1954 Beavers
2,723,725 A 11/1955 Keiffer
2,756,842 A 7/1956 Chamberlin et al.
2,813,708 A 11/1957 Frey
2,827,424 A 3/1958 Homan
2,873,816 A 2/1959 Emil et al.
2,902,991 A 9/1959 Whitman
2,907,698 A 10/1959 Schulz
3,015,893 A 1/1962 McCreary
3,033,764 A 5/1962 Hannes
3,224,805 A 12/1965 Clyatt
3,448,012 A 6/1969 Allred
3,462,345 A 8/1969 Kernan
3,511,030 A 5/1970 Brown et al.
3,542,650 A 11/1970 Kulakov
3,545,470 A 12/1970 Paton
3,592,742 A 7/1971 Thompson
3,616,408 A 10/1971 Hickam
3,623,511 A 11/1971 Levin
3,630,852 A 12/1971 Nashan et al.
3,652,403 A 3/1972 Knappstein et al.
3,676,305 A 7/1972 Cremer
3,709,794 A 1/1973 Kinzler et al.
3,710,551 A 1/1973 Sved
3,746,626 A 7/1973 Morrison, Jr.
3,748,235 A 7/1973 Pries
3,784,034 A 1/1974 Thompson
3,806,032 A 4/1974 Pries
3,811,572 A 5/1974 Tatterson
3,836,161 A 10/1974 Pries
3,839,156 A 10/1974 Jakobi et al.
3,844,900 A 10/1974 Schulte
3,857,758 A 12/1974 Mole
3,875,016 A 4/1975 Schmidt-Balve
3,876,143 A 4/1975 Rossow et al.
3,876,506 A 4/1975 Dix et al.
3,878,053 A 4/1975 Hyde
3,894,302 A 7/1975 Lasater
3,897,312 A 7/1975 Armour et al.
3,906,992 A 9/1975 Leach
3,912,091 A 10/1975 Thompson
3,912,597 A 10/1975 MacDonald
3,917,458 A 11/1975 Polak
3,928,144 A 12/1975 Jakimowicz
3,930,961 A 1/1976 Sustarsic et al.
3,933,443 A 1/1976 Lohrmann
3,957,591 A 5/1976 Riecker
3,959,084 A 5/1976 Price
3,963,582 A 6/1976 Helm et al.
3,969,191 A 7/1976 Bollenbach
3,975,148 A 8/1976 Fukuda et al.
3,979,870 A 9/1976 Moore
3,984,289 A 10/1976 Sustarsic et al.
4,004,702 A 1/1977 Szendroi
4,004,983 A 1/1977 Pries
4,025,395 A 5/1977 Ekholm et al.
4,040,910 A 8/1977 Knappstein et al.
4,045,056 A 8/1977 Kandakov et al.
4,045,299 A 8/1977 McDonald
4,059,885 A 11/1977 Oldengott
4,067,462 A 1/1978 Thompson
4,083,753 A 4/1978 Rogers et al.
4,086,231 A 4/1978 Ikio
4,093,245 A 6/1978 Connor
4,100,033 A 7/1978 Holter
4,100,491 A 7/1978 Newman, Jr. et al.
4,111,757 A 9/1978 Carimboli
4,124,450 A 11/1978 MacDonald
4,135,948 A 1/1979 Mertens et al.
4,141,796 A 2/1979 Clark et al.
4,145,195 A 3/1979 Knappstein et al.
4,147,230 A 4/1979 Ormond et al.
4,162,546 A 7/1979 Shortell et al.
4,181,459 A 1/1980 Price
4,189,272 A 2/1980 Gregor et al.
4,194,951 A 3/1980 Pries
4,196,053 A 4/1980 Grohmann
4,211,608 A 7/1980 Kwasnoski et al.
4,211,611 A 7/1980 Bocsanczy
4,213,489 A 7/1980 Cain
4,213,828 A 7/1980 Calderon
4,222,748 A 9/1980 Argo et al.
4,222,824 A 9/1980 Flockenhaus et al.
4,224,109 A 9/1980 Flockenhaus et al.
4,225,393 A 9/1980 Gregor et al.
4,235,830 A 11/1980 Bennett et al.
4,239,602 A 12/1980 La Bate
4,248,671 A 2/1981 Belding
4,249,997 A 2/1981 Schmitz
4,263,099 A 4/1981 Porter
4,268,360 A 5/1981 Tsuzuki et al.
4,271,814 A 6/1981 Lister
4,284,478 A 8/1981 Brommel
4,285,772 A 8/1981 Kress
4,287,024 A 9/1981 Thompson
4,289,479 A 9/1981 Johnson
4,289,584 A 9/1981 Chuss et al.
4,289,585 A 9/1981 Wagener et al.
4,296,938 A 10/1981 Offermann et al.
4,299,666 A 11/1981 Ostmann
4,302,935 A 12/1981 Cousimano
4,303,615 A 12/1981 Jarmell et al.
4,307,673 A 12/1981 Caughey
4,314,787 A 2/1982 Kwasnik et al.
4,324,568 A 4/1982 Wilcox et al.
4,330,372 A 5/1982 Cairns et al.
4,334,963 A 6/1982 Stog
4,336,843 A 6/1982 Petty
4,340,445 A 7/1982 Kucher et al.
4,342,195 A 8/1982 Lo
4,344,820 A 8/1982 Thompson
4,344,822 A 8/1982 Schwartz et al.
4,353,189 A 10/1982 Thiersch et al.
4,366,029 A 12/1982 Bixby et al.
4,373,244 A 2/1983 Mertens et al.

(56) References Cited

U.S. PATENT DOCUMENTS 4,375,388 A 3/1983 Hara et al.
4,391,674 A 7/1983 Velmin et al.
4,392,824 A 7/1983 Struck et al.
4,394,217 A 7/1983 Holz et al.
4,395,269 A 7/1983 Schuler
4,396,394 A 8/1983 Li et al.
4,396,461 A 8/1983 Neubaum et al.
4,407,237 A 10/1983 Merritt
4,421,070 A 12/1983 Sullivan
4,431,484 A 2/1984 Weber et al.
4,439,277 A 3/1984 Dix
4,440,098 A 4/1984 Adams
4,445,977 A 5/1984 Husher
4,446,018 A 5/1984 Cerwick
4,448,541 A 5/1984 Lucas
4,452,749 A 6/1984 Kolvek et al.
4,459,103 A 7/1984 Gieskieng
4,469,446 A 9/1984 Goodboy
4,474,344 A 10/1984 Bennett
4,487,137 A 12/1984 Horvat et al.
4,498,786 A 2/1985 Ruscheweyh
4,506,025 A 3/1985 Kleeb et al.
4,508,539 A 4/1985 Nakai
4,527,488 A 7/1985 Lindgren
4,564,420 A 1/1986 Spindeler et al.
4,568,426 A 2/1986 Orlando
4,570,670 A 2/1986 Johnson
4,614,567 A 9/1986 Stahlherm et al.
4,643,327 A 2/1987 Campbell
4,645,513 A 2/1987 Kubota et al.
4,655,193 A 4/1987 Blacket
4,655,804 A 4/1987 Kercheval et al.
4,666,675 A 5/1987 Parker et al.
4,680,167 A 7/1987 Orlando
4,690,689 A 9/1987 Malcosky et al.
4,704,195 A 11/1987 Janicka et al.
4,720,262 A 1/1988 Durr et al.
4,724,976 A 2/1988 Lee
4,726,465 A 2/1988 Kwasnik et al.
4,732,652 A 3/1988 Durselen et al.
4,793,981 A 12/1988 Doyle et al.
4,824,614 A 4/1989 Jones et al.
4,889,698 A 12/1989 Moller et al.
4,919,170 A 4/1990 Kallinich et al.
4,929,179 A 5/1990 Breidenbach et al.
4,941,824 A 7/1990 Holter et al.
5,052,922 A 10/1991 Stokman et al.
5,062,925 A 11/1991 Durselen et al.
5,078,822 A 1/1992 Hodges et al.
5,087,328 A 2/1992 Wegerer et al.
5,114,542 A 5/1992 Childress et al.
5,213,138 A 5/1993 Presz
5,227,106 A 7/1993 Kolvek
5,228,955 A 7/1993 Westbrook, III
5,234,601 A 8/1993 Janke et al.
5,318,671 A 6/1994 Pruitt
5,370,218 A 12/1994 Johnson et al.
5,423,152 A 6/1995 Kolvek
5,447,606 A 9/1995 Pruitt
5,480,594 A 1/1996 Wilkerson et al.
5,542,650 A 8/1996 Abel et al.
5,622,280 A 4/1997 Mays et al.
5,659,110 A 8/1997 Herden et al.
5,670,025 A 9/1997 Baird
5,687,768 A 11/1997 Albrecht et al.
5,715,962 A 2/1998 McDonnell
5,752,548 A 5/1998 Matsumoto et al.
5,787,821 A 8/1998 Bhat et al.
5,810,032 A 9/1998 Hong et al.
5,816,210 A 10/1998 Yamaguchi
5,857,308 A 1/1999 Dismore et al.
5,913,448 A 6/1999 Mann et al.
5,928,476 A 7/1999 Daniels
5,966,886 A 10/1999 Di Loreto
5,968,320 A 10/1999 Sprague
6,017,214 A 1/2000 Sturgulewski
6,059,932 A 5/2000 Sturgulewski
6,139,692 A 10/2000 Tamura et al.
6,152,668 A 11/2000 Knoch
6,187,148 B1 2/2001 Sturgulewski
6,189,819 B1 2/2001 Racine
6,290,494 B1 9/2001 Barkdoll
6,412,221 B1 7/2002 Emsbo
6,596,128 B2 7/2003 Westbrook
6,626,984 B1 9/2003 Taylor
6,699,035 B2 3/2004 Brooker
6,758,875 B2 7/2004 Reid et al.
6,907,895 B2 6/2005 Johnson et al.
6,946,011 B2 9/2005 Snyder
6,964,236 B2 11/2005 Schucker
7,056,390 B2 6/2006 Fratello
7,077,892 B2 7/2006 Lee
7,314,060 B2 1/2008 Chen et al.
7,331,298 B2 2/2008 Barkdoll et al.
7,433,743 B2 10/2008 Pistikopoulos et al.
7,497,930 B2 3/2009 Barkdoll et al.
7,611,609 B1 11/2009 Valia et al.
7,644,711 B2 1/2010 Creel
7,722,843 B1 5/2010 Srinivasachar
7,727,307 B2 6/2010 Winkler
7,785,447 B2 8/2010 Eatough et al.
7,803,627 B2 9/2010 Hodges et al.
7,823,401 B2 11/2010 Takeuchi et al.
7,827,689 B2 11/2010 Crane
7,998,316 B2 8/2011 Barkdoll
8,071,060 B2 12/2011 Ukai et al.
8,079,751 B2 12/2011 Kapila et al.
8,080,088 B1 12/2011 Srinivasachar
8,146,376 B1 4/2012 Williams et al.
8,152,970 B2 4/2012 Barkdoll et al.
8,236,142 B2 8/2012 Westbrook
8,266,853 B2 9/2012 Bloom et al.
8,398,935 B2 3/2013 Howell et al.
8,409,405 B2 4/2013 Kim et al.
8,500,881 B2 8/2013 Orita et al.
8,515,508 B2 8/2013 Kawamura et al.
8,647,476 B2 2/2014 Kim et al.
8,800,795 B2 8/2014 Hwang
8,956,995 B2 2/2015 Masatsugu et al.
8,980,063 B2 3/2015 Kim et al.
9,039,869 B2 5/2015 Kim et al.
9,057,023 B2 6/2015 Reichelt et al.
9,103,234 B2 8/2015 Gu et al.
9,193,915 B2 11/2015 West et al.
9,238,778 B2 1/2016 Quanci et al.
9,243,186 B2 1/2016 Quanci et al.
9,249,357 B2 2/2016 Quanci et al.
9,273,249 B2 3/2016 Quanci et al.
9,359,554 B2 6/2016 Quanci et al.
9,404,043 B2 8/2016 Kim
9,498,786 B2 11/2016 Pearson
10,047,295 B2 * 8/2018 Chun ..... C10B 45/00
10,323,192 B2 6/2019 Quanci et al.
10,578,521 B1 3/2020 Dinakaran et al.
10,732,621 B2 8/2020 Cella et al.
2002/0170605 A1 11/2002 Shiraishi et al.
2003/0014954 A1 1/2003 Ronning et al.
2003/0015809 A1 1/2003 Carson
2003/0057083 A1 3/2003 Eatough et al.
2005/0087767 A1 4/2005 Fitzgerald et al.
2006/0102420 A1 5/2006 Huber et al.
2006/0149407 A1 7/2006 Markham et al.
2007/0087946 A1 4/2007 Quest et al.
2007/0116619 A1 5/2007 Taylor et al.
2007/0251198 A1 11/2007 Witter
2008/0028935 A1 2/2008 Andersson
2008/0179165 A1 7/2008 Chen et al.
2008/0257236 A1 10/2008 Green
2008/0271985 A1 11/2008 Yamasaki
2008/0289305 A1 11/2008 Girondi
2009/0007785 A1 1/2009 Kimura et al.
2009/0032385 A1 2/2009 Engle
2009/0152092 A1 6/2009 Kim et al.
2009/0162269 A1 6/2009 Barger et al.

(56) References Cited

U.S. PATENT DOCUMENTS

| | | | |
|---|---|---|---|
| 2009/0217576 | A1 | 9/2009 | Kim et al. |
| 2009/0257932 | A1 | 10/2009 | Canari et al. |
| 2009/0283395 | A1 | 11/2009 | Hippe |
| 2010/0095521 | A1 | 4/2010 | Kartal et al. |
| 2010/0106310 | A1 | 4/2010 | Grohman |
| 2010/0113266 | A1 | 5/2010 | Abe et al. |
| 2010/0115912 | A1 | 5/2010 | Worley |
| 2010/0119425 | A1 | 5/2010 | Palmer |
| 2010/0181297 | A1 | 7/2010 | Whysail |
| 2010/0196597 | A1 | 8/2010 | Di Loreto |
| 2010/0276269 | A1 | 11/2010 | Schuecker et al. |
| 2010/0287871 | A1 | 11/2010 | Bloom et al. |
| 2010/0300867 | A1 | 12/2010 | Kim et al. |
| 2010/0314234 | A1 | 12/2010 | Knoch et al. |
| 2011/0000284 | A1 | 1/2011 | Kumar et al. |
| 2011/0014406 | A1 | 1/2011 | Coleman et al. |
| 2011/0048917 | A1 | 3/2011 | Kim et al. |
| 2011/0088600 | A1 | 4/2011 | McRae |
| 2011/0120852 | A1 | 5/2011 | Kim |
| 2011/0144406 | A1 | 6/2011 | Masatsugu et al. |
| 2011/0168482 | A1 | 7/2011 | Merchant et al. |
| 2011/0174301 | A1 | 7/2011 | Haydock et al. |
| 2011/0192395 | A1 | 8/2011 | Kim |
| 2011/0198206 | A1 | 8/2011 | Kim et al. |
| 2011/0223088 | A1 | 9/2011 | Chang et al. |
| 2011/0253521 | A1 | 10/2011 | Kim |
| 2011/0291827 | A1 | 12/2011 | Baldocchi et al. |
| 2011/0313218 | A1 | 12/2011 | Dana |
| 2011/0315538 | A1 | 12/2011 | Kim et al. |
| 2012/0024688 | A1 | 2/2012 | Barkdoll |
| 2012/0030998 | A1 | 2/2012 | Barkdoll et al. |
| 2012/0031076 | A1 | 2/2012 | Frank et al. |
| 2012/0125709 | A1 | 5/2012 | Merchant et al. |
| 2012/0152720 | A1 | 6/2012 | Reichelt et al. |
| 2012/0177541 | A1 | 7/2012 | Mutsuda et al. |
| 2012/0180133 | A1 | 7/2012 | Ai-Harbi et al. |
| 2012/0228115 | A1 | 9/2012 | Westbrook |
| 2012/0247939 | A1 | 10/2012 | Kim et al. |
| 2012/0305380 | A1 | 12/2012 | Wang et al. |
| 2012/0312019 | A1 | 12/2012 | Rechtman |
| 2013/0020781 | A1 | 1/2013 | Kishikawa |
| 2013/0045149 | A1 | 2/2013 | Miller |
| 2013/0216717 | A1 | 8/2013 | Rago et al. |
| 2013/0220373 | A1 | 8/2013 | Kim |
| 2013/0306462 | A1 | 11/2013 | Kim et al. |
| 2014/0033917 | A1 | 2/2014 | Rodgers et al. |
| 2014/0039833 | A1 | 2/2014 | Sharpe, Jr. et al. |
| 2014/0061018 | A1 | 3/2014 | Sarpen et al. |
| 2014/0083836 | A1 | 3/2014 | Quanci et al. |
| 2014/0182195 | A1 | 7/2014 | Quanci et al. |
| 2014/0182683 | A1 | 7/2014 | Quanci et al. |
| 2014/0183023 | A1 | 7/2014 | Quanci et al. |
| 2014/0183024 | A1 | 7/2014 | Chun et al. |
| 2014/0208997 | A1 | 7/2014 | Alferyev et al. |
| 2014/0224123 | A1 | 8/2014 | Walters |
| 2014/0262139 | A1 | 9/2014 | Choi et al. |
| 2014/0262726 | A1 | 9/2014 | West et al. |
| 2015/0122629 | A1 | 5/2015 | Freimuth et al. |
| 2015/0175433 | A1 | 6/2015 | Micka et al. |
| 2015/0219530 | A1 | 8/2015 | Li et al. |
| 2015/0247092 | A1 | 9/2015 | Quanci et al. |
| 2015/0287026 | A1 | 10/2015 | Quanci et al. |
| 2015/0328576 | A1 | 11/2015 | Quanci et al. |
| 2015/0361346 | A1 | 12/2015 | West et al. |
| 2015/0361347 | A1 | 12/2015 | Ball et al. |
| 2016/0026193 | A1 | 1/2016 | Rhodes et al. |
| 2016/0032193 | A1 | 2/2016 | Sarpen et al. |
| 2016/0048139 | A1 | 2/2016 | Samples et al. |
| 2016/0060532 | A1 | 3/2016 | Quanci et al. |
| 2016/0060533 | A1 | 3/2016 | Quanci et al. |
| 2016/0060534 | A1 | 3/2016 | Quanci et al. |
| 2016/0060536 | A1 | 3/2016 | Quanci et al. |
| 2016/0149944 | A1 | 5/2016 | Obermeier et al. |
| 2016/0152897 | A1 | 6/2016 | Quanci et al. |
| 2016/0154171 | A1 | 6/2016 | Kato et al. |
| 2016/0160123 | A1 | 6/2016 | Quanci et al. |
| 2016/0186063 | A1 | 6/2016 | Quanci et al. |
| 2016/0186064 | A1 | 6/2016 | Quanci et al. |
| 2016/0186065 | A1 | 6/2016 | Quanci et al. |
| 2016/0222297 | A1 | 8/2016 | Choi et al. |
| 2016/0319197 | A1 | 11/2016 | Quanci et al. |
| 2016/0319198 | A1 | 11/2016 | Quanci et al. |
| 2017/0015908 | A1 | 1/2017 | Quanci et al. |
| 2017/0137714 | A1 | 5/2017 | West et al. |
| 2017/0182447 | A1 | 6/2017 | Sappok et al. |
| 2017/0183569 | A1 | 6/2017 | Quanci et al. |
| 2017/0253803 | A1 | 9/2017 | West et al. |
| 2017/0253804 | A1 | 9/2017 | Quanci et al. |
| 2017/0261417 | A1 | 9/2017 | Zhang |
| 2017/0352243 | A1 | 12/2017 | Quanci et al. |
| 2019/0317167 | A1 | 10/2019 | LaBorde et al. |
| 2020/0071190 | A1 | 3/2020 | Wiederin et al. |
| 2020/0139273 | A1 | 5/2020 | Badiei |
| 2020/0173679 | A1 | 6/2020 | O'Reilly et al. |

FOREIGN PATENT DOCUMENTS

| | | | |
|---|---|---|---|
| CA | 2822841 | | 7/2012 |
| CA | 2822857 | | 7/2012 |
| CN | 87212113 | U | 6/1988 |
| CN | 87107195 | A | 7/1988 |
| CN | 2064363 | U | 10/1990 |
| CN | 2139121 | Y | 7/1993 |
| CN | 1092457 | A | 9/1994 |
| CN | 1255528 | A | 6/2000 |
| CN | 1270983 | A | 10/2000 |
| CN | 2528771 | Y | 2/2002 |
| CN | 1358822 | A | 7/2002 |
| CN | 2521473 | Y | 11/2002 |
| CN | 1468364 | A | 1/2004 |
| CN | 1527872 | A | 9/2004 |
| CN | 2668641 | | 1/2005 |
| CN | 1957204 | A | 5/2007 |
| CN | 101037603 | A | 9/2007 |
| CN | 101058731 | A | 10/2007 |
| CN | 101157874 | A | 4/2008 |
| CN | 201121178 | Y | 9/2008 |
| CN | 101395248 | A | 3/2009 |
| CN | 100510004 | C | 7/2009 |
| CN | 101486017 | A | 7/2009 |
| CN | 201264981 | Y | 7/2009 |
| CN | 101497835 | A | 8/2009 |
| CN | 101509427 | A | 8/2009 |
| CN | 101886466 | A | 11/2010 |
| CN | 101910530 | A | 12/2010 |
| CN | 102155300 | A | 8/2011 |
| CN | 2509188 | Y | 11/2011 |
| CN | 202226816 | | 5/2012 |
| CN | 202265541 | U | 6/2012 |
| CN | 102584294 | A | 7/2012 |
| CN | 202415446 | U | 9/2012 |
| CN | 202470353 | U | 10/2012 |
| CN | 103468289 | A | 12/2013 |
| CN | 203981700 | U | 12/2014 |
| CN | 105189704 | A | 12/2015 |
| CN | 106661456 | A | 5/2017 |
| CN | 106687564 | A | 5/2017 |
| CN | 107445633 | A | 12/2017 |
| CN | 100500619 | C | 6/2020 |
| DE | 201729 | C | 9/1908 |
| DE | 212176 | | 7/1909 |
| DE | 1212037 | B | 3/1966 |
| DE | 3231697 | C1 | 1/1984 |
| DE | 3328702 | A1 | 2/1984 |
| DE | 3315738 | C2 | 3/1984 |
| DE | 3329367 | C | 11/1984 |
| DE | 3407487 | C1 | 6/1985 |
| DE | 19545736 | | 6/1997 |
| DE | 19803455 | | 8/1999 |
| DE | 10122531 | A1 | 11/2002 |
| DE | 10154785 | | 5/2003 |
| DE | 102005015301 | | 10/2006 |
| DE | 102006004669 | | 8/2007 |
| DE | 102006026521 | | 12/2007 |

(56) References Cited

FOREIGN PATENT DOCUMENTS

| | | | |
|---|---|---|---|
| DE | 102009031436 | | 1/2011 |
| DE | 102011052785 | | 12/2012 |
| EP | 0126399 | A1 | 11/1984 |
| EP | 0208490 | | 1/1987 |
| EP | 0903393 | A2 | 3/1999 |
| EP | 1538503 | A1 | 6/2005 |
| EP | 2295129 | | 3/2011 |
| EP | 2468837 | A1 | 6/2012 |
| FR | 2339664 | | 8/1977 |
| GB | 364236 | A | 1/1932 |
| GB | 368649 | A | 3/1932 |
| GB | 441784 | | 1/1936 |
| GB | 606340 | | 8/1948 |
| GB | 611524 | | 11/1948 |
| GB | 725865 | | 3/1955 |
| GB | 871094 | | 6/1961 |
| GB | 923205 | A | 5/1963 |
| JP | S50148405 | | 11/1975 |
| JP | S59019301 | | 2/1978 |
| JP | 54054101 | | 4/1979 |
| JP | S5453103 | A | 4/1979 |
| JP | 57051786 | | 3/1982 |
| JP | 57051787 | | 3/1982 |
| JP | 57083585 | | 5/1982 |
| JP | 57090092 | | 6/1982 |
| JP | S57172978 | A | 10/1982 |
| JP | 58091788 | | 5/1983 |
| JP | 59051978 | | 3/1984 |
| JP | 59053589 | | 3/1984 |
| JP | 59071388 | | 4/1984 |
| JP | 59108083 | | 6/1984 |
| JP | 59145281 | | 8/1984 |
| JP | 60004588 | | 1/1985 |
| JP | 61106690 | | 5/1986 |
| JP | 62011794 | | 1/1987 |
| JP | 62285980 | | 12/1987 |
| JP | 01103694 | | 4/1989 |
| JP | 01249886 | | 10/1989 |
| JP | H0319127 | | 3/1991 |
| JP | 03197588 | | 8/1991 |
| JP | 04159392 | | 6/1992 |
| JP | H04178494 | A | 6/1992 |
| JP | H05230466 | A | 9/1993 |
| JP | H0649450 | A | 2/1994 |
| JP | H0654753 | U | 7/1994 |
| JP | H06264062 | | 9/1994 |
| JP | H06299156 | A | 10/1994 |
| JP | 07188668 | | 7/1995 |
| JP | 07216357 | | 8/1995 |
| JP | H07204432 | | 8/1995 |
| JP | 08104875 | A | 4/1996 |
| JP | 08127778 | | 5/1996 |
| JP | H10273672 | A | 10/1998 |
| JP | H11-131074 | | 5/1999 |
| JP | 2000204373 | A | 7/2000 |
| JP | 2000219883 | A | 8/2000 |
| JP | 2001055576 | A | 2/2001 |
| JP | 2001200258 | | 7/2001 |
| JP | 2002097472 | A | 4/2002 |
| JP | 2002106941 | | 4/2002 |
| JP | 2003041258 | | 2/2003 |
| JP | 2003071313 | | 3/2003 |
| JP | 2003292968 | A | 10/2003 |
| JP | 2003342581 | A | 12/2003 |
| JP | 2005503448 | A | 2/2005 |
| JP | 2005154597 | A | 6/2005 |
| JP | 2005263983 | A | 9/2005 |
| JP | 2005344085 | A | 12/2005 |
| JP | 2006188608 | A | 7/2006 |
| JP | 2007063420 | A | 3/2007 |
| JP | 4101226 | B2 | 6/2008 |
| JP | 2008231278 | A | 10/2008 |
| JP | 2009019106 | A | 1/2009 |
| JP | 2009073864 | A | 4/2009 |
| JP | 2009073865 | A | 4/2009 |
| JP | 2009144121 | | 7/2009 |
| JP | 2010229239 | A | 10/2010 |
| JP | 20120438389 | A | 11/2010 |
| JP | 2011504947 | A | 2/2011 |
| JP | 2011068733 | A | 4/2011 |
| JP | 2011102351 | A | 5/2011 |
| JP | 2012102302 | | 5/2012 |
| JP | 2013006957 | A | 1/2013 |
| JP | 2013510910 | | 3/2013 |
| JP | 2013189322 | A | 9/2013 |
| JP | 20140404502 | A | 3/2014 |
| JP | 2015094091 | A | 5/2015 |
| JP | 2016169897 | A | 9/2016 |
| KR | 1019960008754 | | 10/1996 |
| KR | 19990017156 | U | 5/1999 |
| KR | 1019990054426 | | 7/1999 |
| KR | 20000042375 | A | 7/2000 |
| KR | 100296700 | B1 | 10/2001 |
| KR | 20030012458 | A | 2/2003 |
| KR | 1020050053861 | A | 6/2005 |
| KR | 20060132336 | A | 12/2006 |
| KR | 100737393 | B1 | 7/2007 |
| KR | 100797852 | | 1/2008 |
| KR | 20080069170 | A | 7/2008 |
| KR | 20110010452 | A | 2/2011 |
| KR | 101314288 | | 4/2011 |
| KR | 20120033091 | A | 4/2012 |
| KR | 20130050807 | | 5/2013 |
| KR | 101318388 | | 10/2013 |
| KR | 20140042526 | A | 4/2014 |
| KR | 20150011084 | A | 1/2015 |
| KR | 20170038102 | A | 4/2017 |
| KR | 20170058808 | A | 5/2017 |
| KR | 101862491 | B1 | 5/2018 |
| RU | 2083532 | C1 | 7/1997 |
| RU | 2441898 | C2 | 2/2012 |
| RU | 2493233 | C2 | 9/2013 |
| SU | 1535880 | A1 | 1/1990 |
| TW | 201241166 | A1 | 10/2012 |
| TW | 201245431 | A1 | 11/2012 |
| UA | 50580 | | 10/2002 |
| WO | WO9012074 | | 10/1990 |
| WO | WO9945083 | | 9/1999 |
| WO | WO02062922 | | 8/2002 |
| WO | WO2005023649 | | 3/2005 |
| WO | WO2005115583 | | 12/2005 |
| WO | WO2007103649 | | 9/2007 |
| WO | WO2008034424 | | 3/2008 |
| WO | WO2011000447 | | 1/2011 |
| WO | WO2011126043 | | 10/2011 |
| WO | WO2012029979 | | 3/2012 |
| WO | WO2012031726 | | 3/2012 |
| WO | WO2013023872 | | 2/2013 |
| WO | WO2010107513 | | 9/2013 |
| WO | WO2014021909 | | 2/2014 |
| WO | WO2014043667 | | 3/2014 |
| WO | WO2014105064 | | 7/2014 |
| WO | WO2014153050 | | 9/2014 |
| WO | WO2016004106 | | 1/2016 |
| WO | WO2016033511 | | 3/2016 |

OTHER PUBLICATIONS

U.S. Appl. No. 16/251,352, filed Jan. 18, 2019, Quanci et al.

Examination Report for European Application No. 14768073.0; dated Mar. 29, 2019; 5 pages.

U.S. Appl. No. 16/047,198, filed Jul. 27, 2018, Quanci et al.

ASTM D5341-99(2010)e1, Standard Test Method for Measuring Coke Reactivity Index (CRI) and Coke Strength After Reaction (CSR), ASTM International, West Conshohocken, PA, 2010.

Basset et al., "Calculation of steady flow pressure loss coefficients for pipe junctions," Proc Instn Mech Engrs., vol. 215, Part C. IMechIE 2001.

Beckman et al., "Possibilities and limits of cutting back coking plant output," Stahl Und Eisen, Verlag Stahleisen, Dusseldorf, DE, vol. 130, No. 8, Aug. 16, 2010, pp. 57-67.

(56) References Cited

OTHER PUBLICATIONS

Bloom, et al., "Modular cast block—The future of coke oven repairs," Iron & Steel Technol, AIST, Warrendale, PA, vol. 4, No. 3, Mar. 1, 2007, pp. 61-64.
Boyes, Walt. (2003), Instrumentation Reference Book (3rd Edition)—34.7.4.6 Infrared and Thermal Cameras, Elsevier. Online version available at: https://app.knovel.com/hotlink/pdf/id:kt004QMGV6/instrumentation-reference-2/ditigal-video.
Clean coke process: process development studies by USS Engineers and Consultants, Inc., Wisconsin Tech Search, request date Oct. 5, 2011, 17 pages.
"Conveyor Chain Designer Guild", Mar. 27, 2014 (date obtained from wayback machine), Renold.com, Section 4, available online at: http://www.renold/com/upload/renoldswitzerland/conveyor_chain_-_designer_guide.pdf.
Costa, et al., "Edge Effects on the Flow Characteristics in a 90 deg Tee Junction," Transactions of the ASME, Nov. 2006, vol. 128, pp. 1204-1217.
Crelling, et al., "Effects of Weathered Coal on Coking Properties and Coke Quality", Fuel, 1979, vol. 58, Issue 7, pp. 542-546.
Database WPI, Week 199115, Thomson Scientific, Lond, GB; AN 1991-107552.
Diez, et al., "Coal for Metallurgical Coke Production: Predictions of Coke Quality and Future Requirements for Cokemaking", International Journal of Coal Geology, 2002, vol. 50, Issue 1-4, pp. 389-412.
JP 03-197588, Inoue Keizo et al., Method and Equipment for Boring Degassing Hole in Coal Charge in Coke Oven, Japanese Patent (Abstract Only) Aug. 28, 1991.
JP 04-159392, Inoue Keizo et al., Method and Equipment for Opening Hole for Degassing of Coal Charge in Coke Oven, Japanese Patent (Abstract Only) Jun. 2, 1992.
Kerlin, Thomas (1999), Practical Thermocouple Thermometry—1.1 The Thermocouple. ISA. Online version available at https:app.knovel.com/pdf/id:kt007XPTM3/practical-thermocouple/the-thermocouple.
Kochanski et al., "Overview of Uhde Heat Recovery Cokemaking Technology," AISTech Iron and Steel Technology Conference Proceedings, Association for Iron and Steel Technology, U.S., vol. 1, Jan. 1, 2005, pp. 25-32.
Practical Technical Manual of Refractories, Baoyu Hu, etc., Beijing: Metallurgical Industry Press, Chapter 6; 2004, 6-30.
Refractories for Ironmaking and Steelmaking: A History of Battles over High Temperatures; Kyoshi Sugita (Japan, Shaolin Zhang), 1995, p. 160, 2004, 2-29.
Rose, Harold J., "The Selection of Coals for the Manufacture of Coke," American Institute of Mining and Metallurgical Engineers, Feb. 1926, 8 pages.
Madias, et al., "A review on stamped charging of coals" (2013). Available at https://www.researchgate.net/publicatoin/263887759_A_review_on_stamped_charging_of_coals.
Metallurgical Code MSDS, ArcelorMittal, May 30, 2011, available online at http://dofasco.arcelormittal.com/-/media/Files/a/Arcelormittal-Canada/material-safety/metallurgical-coke.pdf.
"Middletown Coke Company HRSG Maintenance BACT Analysis Option 1—Individual Spray Quenches Sun Heat Recovery Coke Facility Process Flow Diagram Middletown Coke Company 100 Oven Case #1-24.5 VM", (Sep. 1, 2009), URL: http://web.archive.org/web/20090901042738/http://epa.ohio.gov/portals/27/transfer/ptiApplication/mcc/new/262504.pdf, (Feb. 12, 2016), XP055249803 [X] 1-13 * p. 7 * * pp. 8-11 *.
Waddell, et al., "Heat-Recovery Cokemaking Presentation," Jan. 1999, pp. 1-25.
Walker D N et al, "Sun Coke Company's heat recovery cokemaking technology high coke quality and low environmental impact", Revue De Metallurgie—Cahiers D'Informations Techniques, Revue De Metallurgie. Paris, FR, (Mar. 1, 2003), vol. 100, No. 3, ISSN 0035-1563, p. 23.
Westbrook, "Heat-Recovery Cokemaking at Sun Coke," AISE Steel Technology, Pittsburg, PA, vol. 76, No. 1, Jan. 1999, pp. 25-28.
Yu et al., "Coke Oven Production Technology," Lianoning Science and Technology Press, first edition, Apr. 2014, pp. 356-358.
"Resources and Utilization of Coking Coal in China," Mingxin Shen ed., Chemical Industry Press, first edition, Jan. 2007, pp. 242-243, 247.
Chinese Office Action in Chinese Application No. 201480014884.4, dated Apr. 22, 2016.
Chinese Office Action in Chinese Application No. 201480014884.4, dated Oct. 20, 2016.
Chinese Office Action in Chinese Application No. 201480014884.4; dated Apr. 24, 2017.
Extended European Search Report in European Application No. 14768073.0, dated Sep. 30, 2016, 7 pages.
Examination Report for European Application No. 14768073.0; dated Oct. 10, 2017; 5 pages.
International Search Report and Written Opinion of International Application No. PCT/US2014/028019; dated Jul. 10, 2014; 12 pages.
Knoerzer et al. "Jewell-Thompson Non-Recovery Cokemaking", Steel Times, Fuel & Metallurgical Journals Ltd. London, GB, vol. 221, No. 4, Apr. 1, 1993, pp. 172-173,184.
Astrom, et al., "Feedback Systems: An Introduction for Scientists and Engineers," Sep. 16, 2006, available on line at http://people/duke.edu/-hpgavin/SystemID/References/Astrom-Feedback-2006.pdf ; 404 pages.
Industrial Furnace Design Handbook, Editor-in-Chief: First Design Institute of First Ministry of Machinery Industry, Beijing: Mechanical Industry Press, pp. 180-183, Oct. 1981.
"What is dead-band control," forum post by user "wireaddict" on AllAboutCircuits.com message board, Feb. 8, 2007, accessed Oct. 24, 2018 at https:/forum.allaboutcircuits.com/threads/what-is-dead-band-control.4728/; 8 pages.
U.S. Appl. No. 13/830,971, filed Mar. 14, 2013, titled Non-Perpendicular Connections Between Coke Oven Uptakes and a Hot Common Tunnel, and Associated Systems and Methods, Now U.S. Pat. No. 10,047,295.
U.S. Appl. No. 13/730,673, filed Dec. 28, 2012, now U.S. Pat. No. 9,476,547, and titled Exhaust Flow Modifier, Duct Intersection Incorporating The Same, and Methods Therefor.
U.S. Appl. No. 15/281,891, filed Sep. 30, 2016, titled Exhaust Flow Modifier, Duct Intersection Incorporating the Same, and Methods Therefor.
U.S. Appl. No. 16/428,014, filed May 31, 2019, Quanci et al.
Brazilian Examination Report for Brazilian Application No. BR112015023324-4; dated Jul. 9, 2019; 7 pages.
U.S. Appl. No. 16/704,689, filed Dec. 5, 2019, West et al.
U.S. Appl. No. 16/729,036, filed Dec. 27, 2019, Quanci et at.
U.S. Appl. No. 16/729,053, filed Dec. 27, 2019, Quanci et at.
U.S. Appl. No. 16/729,057, filed Dec. 27, 2019, Quanci et at.
U.S. Appl. No. 16/729,068, filed Dec. 27, 2019, Quanci et at.
U.S. Appl. No. 16/729,122, filed Dec. 27, 2019, Quanci et at.
U.S. Appl. No. 16/729,129, filed Dec. 27, 2019, Quanci et at.
U.S. Appl. No. 16/729,157, filed Dec. 27, 2019, Quanci et at.
U.S. Appl. No. 16/729,170, filed Dec. 27, 2019, Quanci et at.
U.S. Appl. No. 16/729,201, filed Dec. 27, 2019, Quanci et at.
U.S. Appl. No. 16/729,212, filed Dec. 27, 2019, Quanci et at.
U.S. Appl. No. 16/729,219, filed Dec. 27, 2019, Quanci et at.
U.S. Appl. No. 16/735,103, filed Jan. 6, 2020, Quanci et al.
Joseph, B., "A tutorial on inferential control and its applications," Proceedings of the 1999 American Control Conference (Cat. No. 99CH36251), San Diego, CA, 1999, pp. 3106-3118 vol. 5.
U.S. Appl. No. 14/655,204, filed Jun. 24, 2015, titled Systems and Methods for Removing Mercury from Emissions Air Distribution in a Coke Oven.
U.S. Appl. No. 16/047,198, filed Jul. 27, 2018, titled Coke Plant Including Exhaust Gas Sharing.
U.S. Appl. No. 14/587,670, filed Dec. 31, 2014, titled Methods for Decarbonizing Coking Ovens, and Associated Systems and Devices.
U.S. Appl. No. 15/987,860, filed May 23, 2018, titled System and Method for Repairing a Coke Oven.
U.S. Appl. No. 16/828,448, filed Mar. 24, 2020, Quanci et al.
U.S. Appl. No. 16/845,530, filed Apr. 10, 2020, Quanci et al.

(56) References Cited

OTHER PUBLICATIONS

Brazilian Office Action for Brazilian Application No. BR112015023324-4; dated Mar. 24, 2020; 4 pages.
Canadian Office Action in Canadian Application No. 2,906,066; dated Feb. 28, 2020; 4 pages.
U.S. Appl. No. 16/897,957, filed Jun. 10, 2020, Ball et al.
U.S. Appl. No. 17/076,563, filed Oct. 21, 2020, Crum et al.
Office Action in Canadian Application No. 2,906,066; dated Sep. 11, 2020; 3 pages.
U.S. Appl. No. 07/587,742, filed Sep. 25, 1990, now U.S. Pat. No. 5,114,542, titled Nonrecovery Coke Oven Battery and Method of Operation.
U.S. Appl. No. 07/878,904, filed May 6, 1992, now U.S. Pat. No. 5,318,671, titled Method of Operation of Nonrecovery Coke Oven Battery.
U.S. Appl. No. 09/783,195, filed Feb. 14, 2001, now U.S. Pat. No. 6,596,128, titled Coke Oven Flue Gas Sharing.
U.S. Appl. No. 07/886,804, filed May 22, 1992, now U.S. Pat. No. 5,228,955, titled High Strength Coke Oven Wall Having Gas Flues Therein.
U.S. Appl. No. 08/059,673, filed May 12, 1993, now U.S. Pat. No. 5,447,606, titled Method of and Apparatus for Capturing Coke Oven Charging Emissions.
U.S. Appl. No. 08/914,140, filed Aug. 19, 1997, now U.S. Pat. No. 5,928,476, titled Nonrecovery Coke Oven Door.
U.S. Appl. No. 09/680,187, filed Oct. 5, 2000, now U.S. Pat. No. 6,290,494, titled Method and Apparatus for Coal Coking.
U.S. Appl. No. 10/933,866, filed Sep. 3, 2004, now U.S. Pat. No. 7,331,298, titled Coke Oven Rotary Wedge Door Latch.
U.S. Appl. No. 11/424,566, filed Jun. 16, 2006, now U.S. Pat. No. 7,497,930, titled Method and Apparatus for Compacting Coal for a Coal Coking Process.
U.S. Appl. No. 12/405,269, filed Mar. 17, 2009, now U.S. Pat. No. 7,998,316, titled Flat Push Coke Wet Quenching Apparatus and Process.
U.S. Appl. No. 13/205,960, filed Aug. 9, 2011, now U.S. Pat. No. 9,321,965, titled Flat Push Coke Wet Quenching Apparatus and Process.
U.S. Appl. No. 11/367,236, filed Mar. 3, 2006, now U.S. Pat. No. 8,152,970, titled Method and Apparatus for Producing Coke.
U.S. Appl. No. 12/403,391, filed Mar. 13, 2009, now U.S. Pat. No. 8,172,930, titled Cleanable In Situ Spark Arrestor.
U.S. Appl. No. 12/849,192, filed Aug. 3, 2010, now U.S. Pat. No. 9,200,225, titled Method and Apparatus for Compacting Coal for a Coal Coking Process.
U.S. Appl. No. 13/631,215, filed Sep. 28, 2012, now U.S. Pat. No. 9,683,740, titled Methods for Handling Coal Processing Emissions and Associated Systems and Devices.
U.S. Appl. No. 13/730,692, filed Dec. 28, 2012, now U.S. Pat. No. 9,193,913, titled Reduced Output Rate Coke Oven Operation With Gas Sharing Providing Extended Process Cycle.
U.S. Appl. No. 14/921,723, filed Oct. 23, 2015, titled Reduced Output Rate Coke Oven Operation With Gas Sharing Providing Extended Process Cycle.
U.S. Appl. No. 14/655,204, now U.S. Pat. No. 10,016,714, filed Jun. 24, 2015, titled Systems and Methods for Removing Mercury From Emissions.
U.S. Appl. No. 16/000,516, filed Jun. 5, 2018, titled Systems and Methods for Removing Mercury from Emissions.
U.S. Appl. No. 13/830,971, filed Mar. 14, 2013, now U.S. Pat. No. 10,047,296, titled Non-Perpendicular Connections Between Coke Oven Uptakes and a Hot Common Tunnel, and Associated Systems and Methods, now U.S. Pat. No. 10,047,295
U.S. Appl. No. 13/730,796, filed Dec. 28, 2012, titled Methods and Systems for Improved Coke Quenching.
U.S. Appl. No. 13/730,598, filed Dec. 28, 2012, now U.S. Pat. No. 9,238,778, titled Systems and Methods for Improving Quenched Coke Recovery.
U.S. Appl. No. 14/952,267, filed Nov. 25, 2015, now U.S. Pat. No. 9,862,888, titled Systems and Methods for Improving Quenched Coke Recovery.
U.S. Appl. No. 15/830,320, filed Dec. 4, 2017, now U.S. Pat. No. 10,323,192, titled Systems and Methods for Improving Quenched Coke Recovery.
U.S. Appl. No. 13/730,735, filed Dec. 28, 2012, now U.S. Pat. No. 9,273,249, titled Systems and Methods for Controlling Air Distribution in a Coke Oven.
U.S. Appl. No. 14/655,013, filed Jun. 23, 2015, titled Vent Stack Lids and Associated Systems and Methods.
U.S. Appl. No. 13/843,166, now U.S. Pat. No. 9,273,250, filed Mar. 15, 2013, titled Methods and Systems for Improved Quench Tower Design.
U.S. Appl. No. 15/014,547, filed Feb. 3, 2016, titled Methods and Systems for Improved Quench Tower Design.
U.S. Appl. No. 14/655,003, filed Jun. 23, 2015, titled Systems and Methods for Maintaining a Hot Car in a Coke Plant.
U.S. Appl. No. 16/897,957, filed Jun. 10, 2020, titled Systems and Methods for Maintaining a Hot Car in a Coke Plant.
U.S. Appl. No. 13/829,588, now U.S. Pat. No. 9,193,915, filed Mar. 14, 2013, titled Horizontal Heat Recovery Coke Ovens Having Monolith Crowns.
U.S. Appl. No. 15/322,176, filed Dec. 27, 2016, now U.S. Pat. No. 10,526,541, titled Horizontal Heat Recovery Coke Ovens Having Monolith Crowns.
U.S. Appl. No. 15/511,036, filed Mar. 14, 2017, titled Coke Ovens Having Monolith Component Construction.
U.S. Appl. No. 16/704,689, filed Dec. 5, 2019, titled Horizontal Heat Recovery Coke Ovens Having Monolith Crowns.
U.S. Appl. No. 13/589,009, filed Aug. 17, 2012, titled Automatic Draft Control System for Coke Plants.
U.S. Appl. No. 15/139,568, filed Apr. 27, 2016, titled Automatic Draft Control System for Coke Plants.
U.S. Appl. No. 13/588,996, now U.S. Pat. No. 9,243,186, filed Aug. 17, 2012, titled Coke Plant Including Exhaust Gas Sharing.
U.S. Appl. No. 14/959,450, filed Dec. 4, 2015, now U.S. Pat. No. 10,041,002, titled Coke Plant Including Exhaust Gas Sharing, now U.S. Pat. No. 10,041,002.
U.S. Appl. No. 16/047,198, filed Jul. 27, 2018, now U.S. Pat. No. 10,611,965, titled Coke Plant Including Exhaust Gas Sharing.
U.S. Appl. No. 16/828,448, filed Mar. 24, 2020, titled Coke Plant Including Exhaust Gas Sharing.
U.S. Appl. No. 13/589,004, now U.S. Pat. No. 9,249,357, filed Aug. 17, 2012, titled Method and Apparatus for Volatile Matter Sharing in Stamp-Charged Coke Ovens.
U.S. Appl. No. 13/730,673, filed Dec. 28, 2012, titled Exhaust Flow Modifier, Duct Intersection Incorporating the Same, and Methods Therefor.
U.S. Appl. No. 15/281,891, filed Sep. 30, 2016, titled Exhaust Flow Modifier, Duck Intersection Incorporating the Same, and Methods Therefor.
U.S. Appl. No. 13/598,394, now U.S. Pat. No. 9,169,439, filed Aug. 29, 2012, titled Method and Apparatus for Testing Coal Coking Properties.
U.S. Appl. No. 14/865,581, filed Sep. 25, 2015, now U.S. Pat. No. 10,053,627, titled Method and Apparatus for Testing Coal Coking Properties, now U.S. Pat. No. 10,053,627
U.S. Appl. No. 14/839,384, filed Aug. 28, 2015, titled Coke Oven Charging System.
U.S. Appl. No. 15/443,246, now U.S. Pat. No. 9,976,089, filed Feb. 27, 2017, titled Coke Oven Charging System.
U.S. Appl. No. 14/587,670, filed Dec. 31, 2014, now U.S. Pat. No. 10,619,101, titled Methods for Decarbonizing Coking Ovens, and Associated Systems and Devices.
U.S. Appl. No. 16/845,530, filed Apr. 10, 2020, titled Methods for Decarbonizing Coking Ovens, and Associated Systems and Devices.
U.S. Appl. No. 14/984,489, filed Dec. 30, 2015, titled Multi-Modal Beds of Coking Material.
U.S. Appl. No. 14/983,837, filed Dec. 30, 2015, titled Multi-Modal Beds of Coking Material.
U.S. Appl. No. 14/986,281, filed Dec. 31, 2015, titled Multi-Modal Beds of Coking Material.

(56) References Cited

OTHER PUBLICATIONS

U.S. Appl. No. 14/987,625, filed Jan. 4, 2016, titled Integrated Coke Plant Automation and Optimization Using Advanced Control and Optimization Techniques.
U.S. Appl. No. 14/839,493, filed Aug. 28, 2015, now U.S. Pat. No. 10,233,392, titled Method and System for Optimizing Coke Plant Operation and Output.
U.S. Appl. No. 16/251,352, filed Jan. 18, 2019, titled Method and System for Optimizing Coke Plant Operation and Output.
U.S. Appl. No. 14/839,551, filed Aug. 28, 2015, now U.S. Pat. No. 10,308,876, titled Burn Profiles for Coke Operations.
U.S. Appl. No. 16/428,014, filed May 31, 2019, titled Improved Burn Profiles for Coke Operations.
U.S. Appl. No. 14/839,588, filed Aug. 28, 2015, now U.S. Pat. No. 9,708,542, titled Method and System for Optimizing Coke Plant Operation and Output.
U.S. Appl. No. 15/392,942, filed Dec. 28, 2016, now U.S. Pat. No. 10,526,542, titled Method and System for Dynamically Charging a Coke Oven.
U.S. Appl. No. 16/735,103, filed Jan. 6, 2020, titled Method and System for Dynamically Charging a Coke Oven.
U.S. Appl. No. 15/614,525, filed Jun. 5, 2017, titled Methods and Systems for Automatically Generating a Remedial Action in an Industrial Facility.
U.S. Appl. No. 15/987,860, filed May 23, 2018, now U.S. Pat. No. 10,851,306, titled System and Method for Repairing a Coke Oven.
U.S. Appl. No. 17/076,563, filed Oct. 21, 2020, titled System and Method for Repairing a Coke Oven.
U.S. Appl. No. 16/729,053, filed Dec. 27, 2019, titled Oven Uptakes.
U.S. Appl. No. 16/729,036, filed Dec. 27, 2019, titled Systems and Methods for Treating a Surface of a Coke Plant.
U.S. Appl. No. 16/729,201, filed Dec. 27, 2019, titled Gaseous Tracer Leak Detection.
U.S. Appl. No. 16/729,122, filed Dec. 27, 2019, titled Methods and Systems for Providing Corrosion Resistant Surfaces in Contaminant Treatment Systems.
U.S. Appl. No. 16/729,068, filed Dec. 27, 2019, titled Systems and Methods for Utilizing Flue Gas.
U.S. Appl. No. 16/729,129, filed Dec. 27, 2019, titled Coke Plant Tunnel Repair and Flexible Joints.
U.S. Appl. No. 16/729,170, filed Dec. 27, 2019, titled Coke Plant Tunnel Repair and Anchor Distribution.
U.S. Appl. No. 16/729,157, filed Dec. 27, 2019, titled Particulate Detection for Industrial Facilities, and Associated Systems and Methods.
U.S. Appl. No. 16/729,057, filed Dec. 27, 2019, titled Decarbonization of Coke Ovens and Associated Systems and Methods.
U.S. Appl. No. 16/729,212, filed Dec. 27, 2019, titled Heat Recovery Oven Foundation.
U.S. Appl. No. 16/729,219, filed Dec. 27, 2019, titled Spring-Loaded Heat Recovery Oven System and Method.

* cited by examiner

NON-PERPENDICULAR CONNECTIONS BETWEEN COKE OVEN UPTAKES AND A HOT COMMON TUNNEL, AND ASSOCIATED SYSTEMS AND METHODS

CROSS-REFERENCE TO RELATED APPLICATION

This application is a continuation of U.S. patent application Ser. No. 13/830,971, filed Mar. 14, 2013, which is a continuation-in-part of U.S. patent application Ser. No. 13/730,673, filed Dec. 28, 2012, which are incorporated herein by reference in their entirety. Further, components and features of embodiments disclosed in the application incorporated by reference may be combined with various components and features disclosed and claimed in the present application.

TECHNICAL FIELD

The present technology is generally directed to non-perpendicular connections between coke oven uptakes and a hot common tunnel, and associated systems and methods.

BACKGROUND

Coke is a solid carbonaceous fuel that is derived from coal. Coke is a favored energy source in a variety of useful applications. For example, coke is often used to smelt iron ore during the steelmaking process. As a further example, coke may also be used to heat commercial buildings or power industrial boilers.

In a typical coking process, an amount of coal is baked in a coke oven at temperatures that generally exceed 2,000 degrees Fahrenheit. The baking process transforms the relatively impure coal into coke, which contains relatively few impurities. At the end of the baking process, the coke typically emerges from the coke oven as a substantially intact piece. The coke typically is removed from the coke oven, loaded into one or more train cars, and transported to a quench tower in order to cool or "quench" the coke before it is made available for distribution for use as a fuel source.

The hot exhaust (i.e. flue gas) emitted during baking is extracted from the coke ovens through a network of ducts, intersections, and transitions. The intersections in the flue gas flow path of a coke plant can lead to significant pressure drop losses, poor flow zones (e.g. dead, stagnant, recirculation, separation, etc.), and poor mixing of air and volatile matter. The high pressure drop losses can lead to higher required draft, leaks, and problems with system control. In addition, poor mixing and resulting localized hot spots can lead to earlier structural degradation due to accelerated localized erosion and thermal wear. Erosion includes deterioration due to high velocity flow eating away at material. Hot spots can lead to thermal degradation of material, which can eventually cause thermal/structural failure. The localized erosion and/or hot spots can, in turn, lead to failures at duct intersections.

Traditional duct intersection designs also result in significant pressure drop losses which may limit the number of coke ovens connected together in a single battery. There are limitations on how much draft a draft fan can pull. Pressure drops in duct intersections can take away from the amount of draft available to exhaust flue gases from the coke ovens. These and other related problems with traditional duct intersection design result in additional capital expenses. Therefore, a need exists to provide improved duct intersection/transitions that can improve mixing, flow distribution, minimize poor flow zones, and reduce pressure drop losses.

DETAILED DESCRIPTION

The present technology is generally directed to non-perpendicular connections between coke oven uptakes and a hot common tunnel, and associated systems and methods. In some embodiments, a coking system includes a coke oven and an uptake duct in fluid communication with the coke oven. The uptake duct has an uptake flow vector of exhaust gas from the coke oven. The system also includes a common tunnel in fluid communication with the uptake duct. The common tunnel has a common flow vector and can be configured to transfer the exhaust gas to a venting system. The uptake flow vector and common flow vector can meet at a non-perpendicular interface to improve mixing between the flow vectors and reduce draft loss in the common tunnel.

Specific details of several embodiments of the technology are described below with reference to FIGS. 1-9. Other details describing well-known structures and systems often associated with coal processing have not been set forth in the following disclosure to avoid unnecessarily obscuring the description of the various embodiments of the technology. Many of the details, dimensions, angles, and other features shown in the Figures are merely illustrative of particular embodiments of the technology. Accordingly, other embodiments can have other details, dimensions, angles, and features without departing from the spirit or scope of the present technology. A person of ordinary skill in the art, therefore, will accordingly understand that the technology may have other embodiments with additional elements, or the technology may have other embodiments without several of the features shown and described below with reference to FIGS. 1-9.

Figure 1:
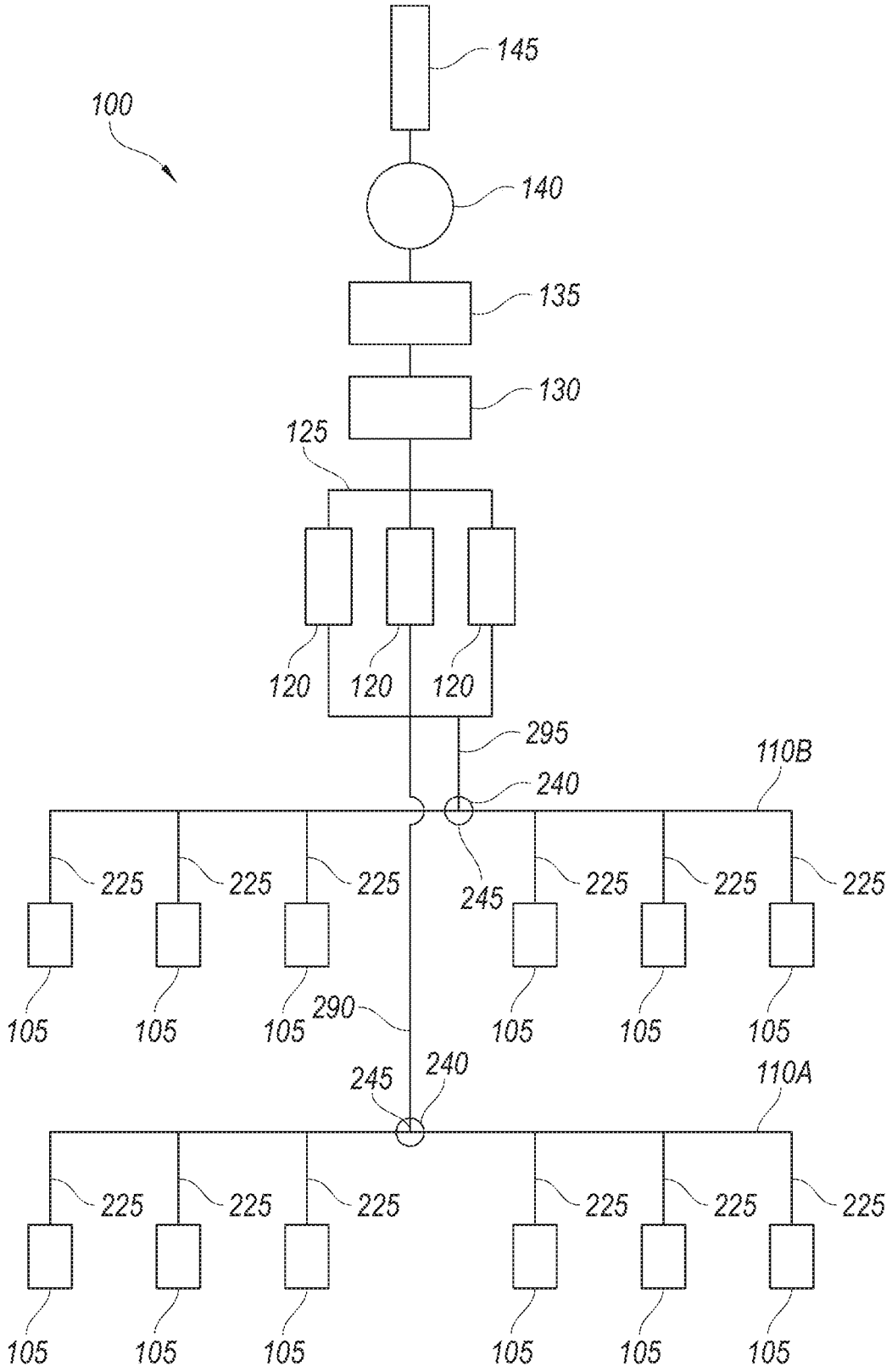
FIG. 1 is a schematic illustration of a horizontal heat recovery coke plant, configured in accordance with embodiments of the technology.

FIG. 1 is a schematic illustration of a horizontal heat recovery (HHR) coke plant 100, configured in accordance with embodiments of the technology. The HHR coke plant 100 comprises ovens 105, along with heat recovery steam generators (HRSGs) 120 and an air quality control system 130 (e.g., an exhaust or flue gas desulfurization (FGD) system), both of which are positioned fluidly downstream from the ovens 105 and both of which are fluidly connected to the ovens 105 by suitable ducts. The HHR coke plant 100 also includes one or more common tunnels 110A, 110B (collectively "common tunnel 110") fluidly connecting individual ovens 105 to the HRSGs 120 via one or more individual uptake ducts 225. In some embodiments, two or more uptake ducts 225 connect each individual oven 105 to the common tunnel 110. A first crossover duct 290 fluidly connects the common tunnel 110A to the HRSGs 120 and a second crossover duct 295 fluidly connects the common tunnel 110B to the HRSGs 120 at respective intersections 245. The common tunnel 110 can further be fluidly connected to one or more bypass exhaust stacks 240. A cooled gas duct 125 transports the cooled gas from the HRSGs to the FGD system 130. Fluidly connected and further downstream are a baghouse 135 for collecting particulates, at least one draft fan 140 for controlling air pressure within the system, and a main gas stack 145 for exhausting cooled, treated exhaust into the environment. Various coke plants 100 can have different proportions of ovens 105, HRSGs 120, uptake ducts 225, common tunnels 110, and other structures. For example, in some coke plants, each oven 105 illustrated in FIG. 1 can represent ten actual ovens.

As will be described in further detail below, in several embodiments the uptake ducts 225 meet the common tunnel 110 at non-perpendicular interfaces. The non-perpendicular interfaces may comprise a fitting within the uptake ducts 225, a fitting within the common tunnel 110, a non-perpendicular uptake duct 225, a non-perpendicular portion of the uptake duct 225, or other feature. The non-perpendicular interfaces can lower the mixing draft loss at the uptake/common tunnel connection by angling the connection in the direction of the common tunnel flow. More specifically, the uptake ducts 225 have an uptake flow having an uptake flow vector (having x, y, and z orthogonal components) and the common tunnel 110 has a common flow having a common flow vector (having x, y, and z orthogonal components). By minimizing the differences between the uptake flow vector and the common flow vector, the lesser the change in the directional momentum of the hot gas and, consequently, the lower the draft losses.

Furthermore, there are interface angles in which the draft in the common tunnel 110 can increase from the addition of the extra mass flow from the uptake duct 225. More specifically, the interface can act as a vacuum aspirator which uses mass flow to pull a vacuum. By aligning the uptake duct 225 mass flow with the common tunnel 110 mass flow (having a velocity vector in the same major flow direction), a coke plant can achieve more vacuum pull and lower draft loss, which can potentially cause a draft increase. The reduced draft loss can be used to reduce the common tunnel 110 size (e.g., diameter) or lower the required overall system draft.

Further, various embodiments of the technology are not limited to the interface between uptake ducts and the common tunnel. Rather, any connection where the gas flow undergoes a significant change in direction can be improved to have a lower draft loss by using a non-perpendicular connection. For example, any of the connections in the exhaust flow path (e.g., between the common tunnel 110 and the bypass exhaust stacks 240) can include ducts meeting head to head; angling these connections can lower draft losses in the manner described above.

Figure 2:
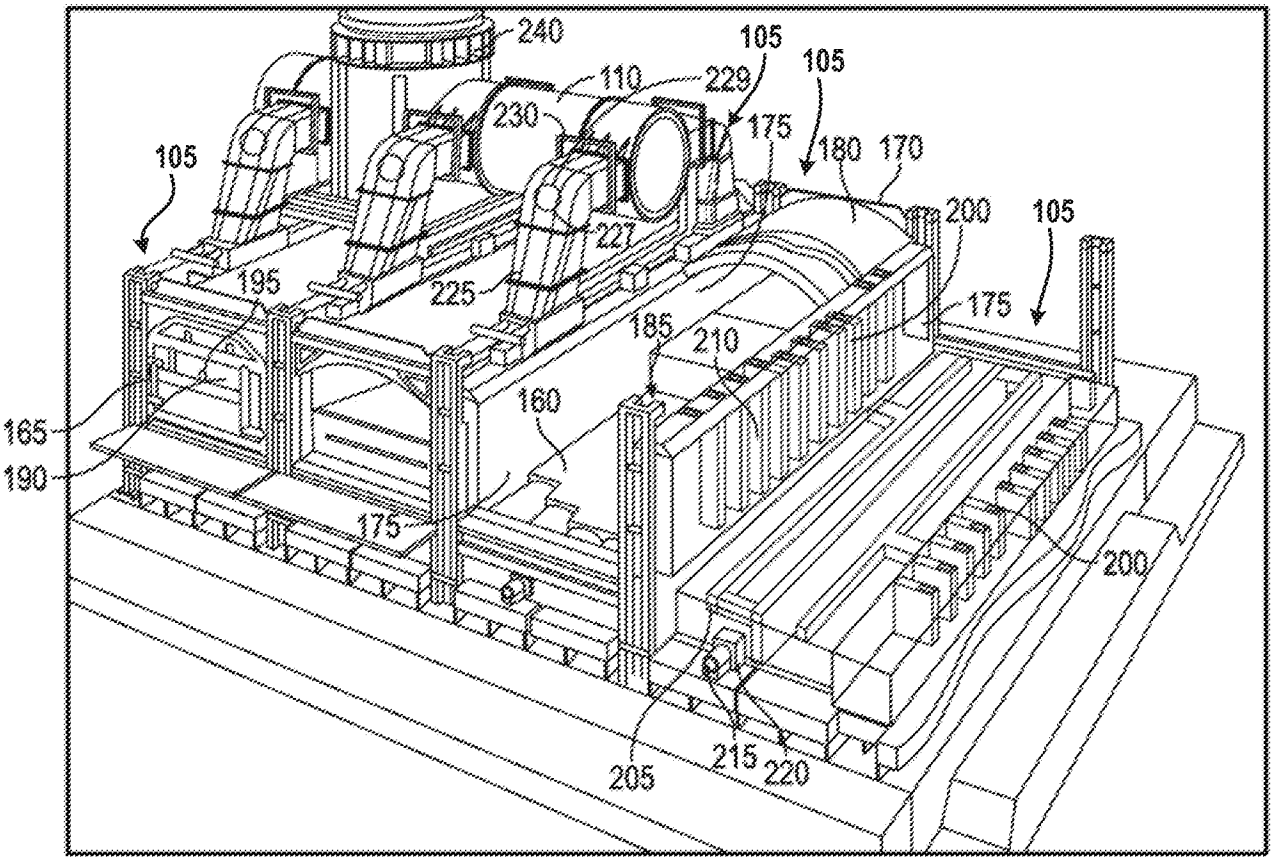
FIG. 2 is an isometric, partial cut-away view of a portion of the horizontal heat recovery coke plant of FIG. 1 configured in accordance with embodiments of the technology.
Figure 3:
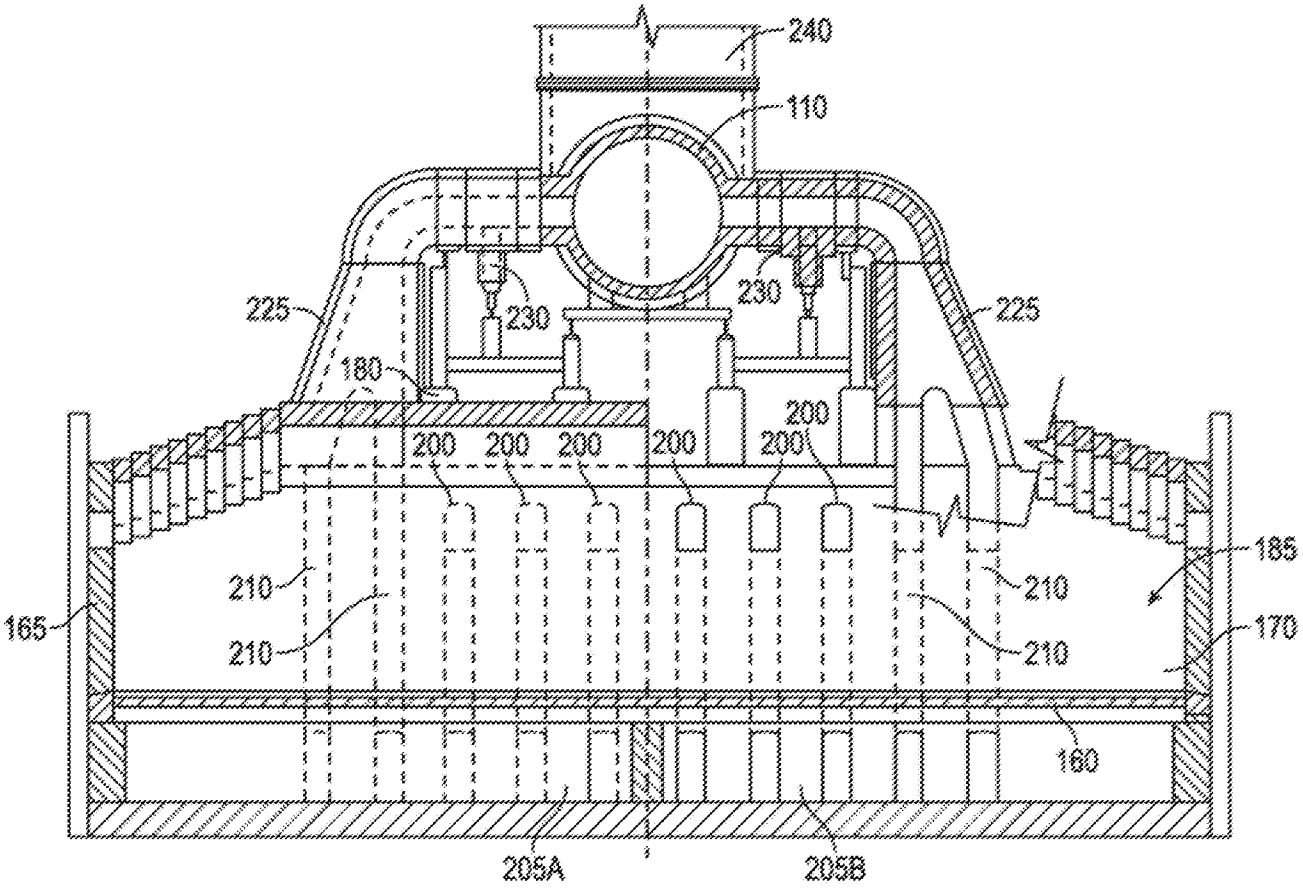
FIG. 3 is a sectional view of a horizontal heat recovery coke oven configured in accordance with embodiments of the technology.

FIGS. 2 and 3 provide further detail regarding the structure and operation of the coke plant 100. More specifically, FIGS. 2 and 3 illustrate further details related to the structure and mechanics of exhaust flow from the ovens to the common tunnel. FIGS. 4 through 9 provide further details regarding various embodiments of non-perpendicular connections between coke oven uptakes ducts and the common tunnel.

FIG. 2 is an isometric, partial cut-away view of a portion of the HHR coke plant 100 of FIG. 1 configured in accordance with embodiments of the technology. FIG. 3 is a sectional view of an HHR coke oven 105 configured in accordance with embodiments of the technology. Referring to FIGS. 2 and 3 together, each oven 105 can include an open cavity defined by a floor 160, a front door 165 forming substantially the entirety of one side of the oven, a rear door 170 opposite the front door 165 forming substantially the entirety of the side of the oven opposite the front door, two sidewalls 175 extending upwardly from the floor 160 intermediate the front 165 and rear 170 doors, and a crown 180 which forms the top surface of the open cavity of an oven chamber 185. Controlling air flow and pressure inside the oven chamber 185 can be critical to the efficient operation of the coking cycle, and therefore the front door 165 includes one or more primary air inlets 190 that allow primary combustion air into the oven chamber 185. Each primary air inlet 190 includes a primary air damper 195 which can be positioned at any of a number of positions between fully open and fully closed to vary the amount of primary air flow into the oven chamber 185. Alternatively, the one or more primary air inlets 190 are formed through the crown 180.

In operation, volatile gases emitted from the coal positioned inside the oven chamber 185 collect in the crown and are drawn downstream in the overall system into downcomer channels 200 formed in one or both sidewalls 175. The downcomer channels fluidly connect the oven chamber 185 with a sole flue 205 positioned beneath the oven floor 160. The sole flue 205 forms a circuitous path beneath the oven floor 160. Volatile gases emitted from the coal can be combusted in the sole flue 205 thereby generating heat to support the carbonization of coal into coke. The downcomer channels 200 are fluidly connected to chimneys or uptake channels 210 formed in one or both sidewalls 175. A secondary air inlet 215 is provided between the sole flue 205 and the atmosphere; the secondary air inlet 215 includes a secondary air damper 220 that can be positioned at any of a number of positions between fully open and fully closed to vary the amount of secondary air flow into the sole flue 205. The uptake channels 210 are fluidly connected to the common tunnel 110 by the one or more uptake ducts 225. A tertiary air inlet 227 is provided between the uptake duct 225 and atmosphere. The tertiary air inlet 227 includes a tertiary air damper 229 which can be positioned at any of a number of positions between fully open and fully closed to vary the amount of tertiary air flow into the uptake duct 225.

In order to provide the ability to control gas flow through the uptake ducts 225 and within the ovens 105, each uptake duct 225 also includes an uptake damper 230. The uptake damper 230 can be positioned at any number of positions between fully open and fully closed to vary the amount of oven draft in the oven 105. The uptake damper 230 can comprise any automatic or manually-controlled flow control or orifice blocking device (e.g., any plate, seal, block, etc.). As used herein, "draft" indicates a negative pressure relative to atmosphere. For example, a draft of 0.1 inches of water indicates a pressure of 0.1 inches of water below atmospheric pressure. Inches of water is a non-SI unit for pressure and is conventionally used to describe the draft at various locations in a coke plant. In some embodiments, the draft ranges from about 0.12 to about 0.16 inches of water in the oven 105. If a draft is increased or otherwise made larger, the pressure moves further below atmospheric pressure. If a draft is decreased, drops, or is otherwise made smaller or lower, the pressure moves towards atmospheric pressure. By controlling the oven draft with the uptake damper 230, the air flow into the oven 105 from the air inlets 190, 215, 227 as well as air leaks into the oven 105 can be controlled. Typically, as shown in FIG. 3, an individual oven 105 includes two uptake ducts 225 and two uptake dampers 230, but the use of two uptake ducts and two uptake dampers is not a necessity; a system can be designed to use just one or more than two uptake ducts and two uptake dampers. All of the ovens 105 are fluidly connected by at least one uptake duct 225 to the common tunnel 110 which is in turn fluidly connected to each HRSG 120 by the crossover ducts 290, 295. The exhaust gases from each oven 105 flow through the common tunnel 110 to the crossover ducts 290, 295.

In operation, coke is produced in the ovens 105 by first loading coal into the oven chamber 185, heating the coal in an oxygen depleted environment, driving off the volatile fraction of coal, and then oxidizing the VM within the oven 105 to capture and utilize the heat given off. The coal volatiles are oxidized within the ovens over an extended coking cycle, and release heat to regeneratively drive the carbonization of the coal to coke. The coking cycle begins when the front door 165 is opened and coal is charged onto the oven floor 160. The coal on the oven floor 160 is known as the coal bed. Heat from the oven (due to the previous coking cycle) starts the carbonization cycle. As discussed above, in some embodiments, no additional fuel other than that produced by the coking process is used. Roughly half of the total heat transfer to the coal bed is radiated down onto the top surface of the coal bed from the luminous flame of the coal bed and the radiant oven crown 180. The remaining half of the heat is transferred to the coal bed by conduction from the oven floor 160 which is convectively heated from the volatilization of gases in the sole flue 205. In this way, a carbonization process "wave" of plastic flow of the coal particles and formation of high strength cohesive coke proceeds from both the top and bottom boundaries of the coal bed.

Typically, each oven 105 is operated at negative pressure so air is drawn into the oven during the reduction process due to the pressure differential between the oven 105 and atmosphere. Primary air for combustion is added to the oven chamber 185 to partially oxidize the coal volatiles, but the amount of this primary air is controlled so that only a portion of the volatiles released from the coal are combusted in the oven chamber 185, thereby releasing only a fraction of their enthalpy of combustion within the oven chamber 185. The primary air is introduced into the oven chamber 185 above the coal bed through the primary air inlets 190 with the amount of primary air controlled by the primary air dampers 195. The primary air dampers 195 can also be used to maintain the desired operating temperature inside the oven chamber 185. The partially combusted gases pass from the oven chamber 185 through the downcomer channels 200 into the sole flue 205, where secondary air is added to the partially combusted gases. The secondary air is introduced through the secondary air inlet 215. The amount of secondary air that is introduced is controlled by the secondary air damper 220. As the secondary air is introduced, the partially combusted gases are more fully combusted in the sole flue 205, thereby extracting the remaining enthalpy of combustion which is conveyed through the oven floor 160 to add heat to the oven chamber 185. The fully or nearly-fully combusted exhaust gases exit the sole flue 205 through the uptake channels 210 and then flow into the uptake duct 225. Tertiary air is added to the exhaust gases via the tertiary air inlet 227, where the amount of tertiary air introduced is controlled by the tertiary air damper 229 so that any remaining fraction of uncombusted gases in the exhaust gases are oxidized downstream of the tertiary air inlet 227.

At the end of the coking cycle, the coal has coked out and has carbonized to produce coke. The coke is preferably removed from the oven 105 through the rear door 170 utilizing a mechanical extraction system. Finally, the coke is quenched (e.g., wet or dry quenched) and sized before delivery to a user.

Figure 4:
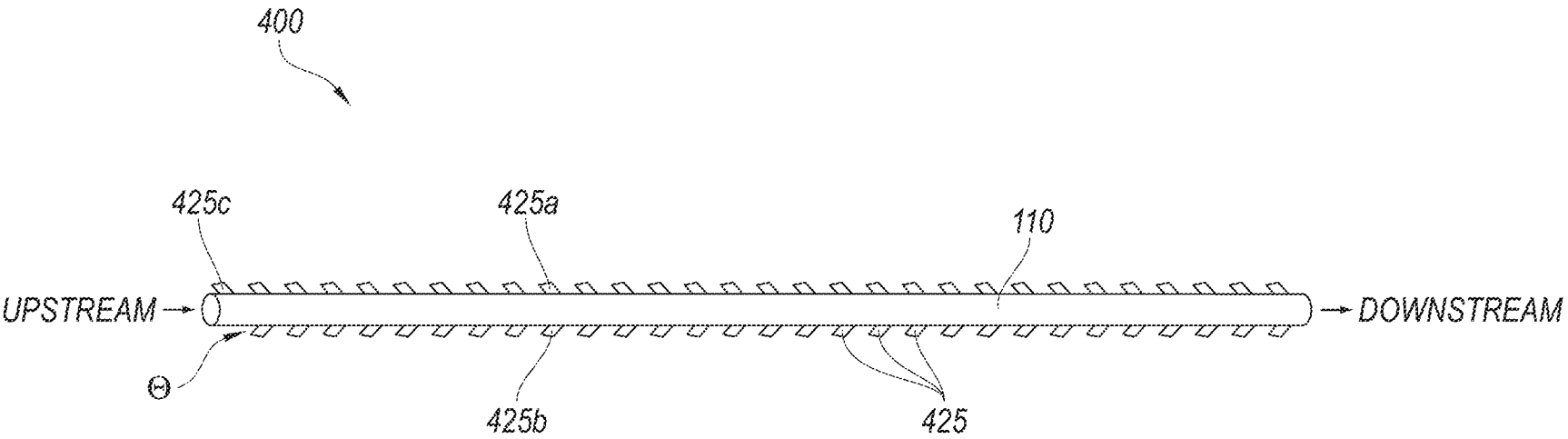
FIG. 4 is a top view of a portion of a horizontal heat recovery coke plant configured in accordance with embodiments of the technology.

FIG. 4 is a top view of a portion of a horizontal heat recovery coke plant 400 configured in accordance with embodiments of the technology. The coke plant 400 includes several features generally similar to the coke plant 100 described above with reference to FIG. 1. For example, the plant 400 includes numerous uptake ducts 425 in fluid communication with coke ovens (not shown) and the hot common tunnel 110. The uptake ducts 425 can include "corresponding" uptake ducts 425*a*, 425*b* opposite one another on opposing lateral sides of the common tunnel 110 and a most-upstream or "end" uptake duct 425*c*. The uptake ducts 425 can channel exhaust gas to the common tunnel 110. The exhaust gas in the common tunnel 110 moves from an "upstream" end toward a "downstream" end.

In the illustrated embodiments, the uptake ducts 425 meet the common tunnel 110 at a non-perpendicular interface. More specifically, the uptake ducts 425 have an upstream angle θ relative to the common tunnel 110. While the upstream angle θ is shown to be approximately 45°, it can be lesser or greater in other embodiments. Further, as will be discussed in more detail below, in some embodiments different uptake ducts 425 can have different upstream angles θ from one another. For example, there may be a combination of perpendicular (90°) and non-perpendicular (less than 90°) interfaces. The non-perpendicular interfaces between the uptake ducts 425 and the common tunnel 110 can improve flow and reduce draft loss in the manner described above.

Figure 5A:
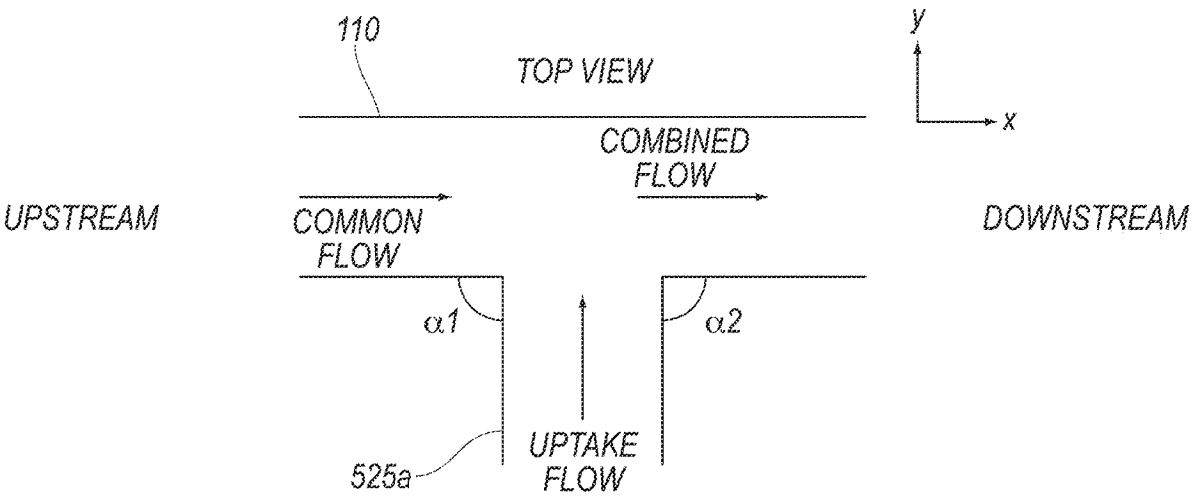
FIG. 5A is a cross-sectional top view of a perpendicular interface between an uptake duct and a common tunnel configured in accordance with embodiments of the technology.

FIG. 5A is a cross-sectional top view of a perpendicular interface between an uptake duct 525*a* and the common tunnel 110 configured in accordance with embodiments of the technology. An uptake flow of exhaust gas in the uptake duct 525*a* intersects a common flow of exhaust gas in the common tunnel 110 to form a combined flow. The uptake duct 525*a* and the common tunnel 110 meet at an interface having an upstream angle $\alpha 1$ and a downstream angle $\alpha 2$ which are each approximately 90°. In other words, using a spherical coordinate system, a direction of the uptake flow vector comprises an azimuthal y-component but no azimuthal x-component, while a direction of the common flow vector and combined flow vector comprises an x-component but no y-component.

Figure 5B:
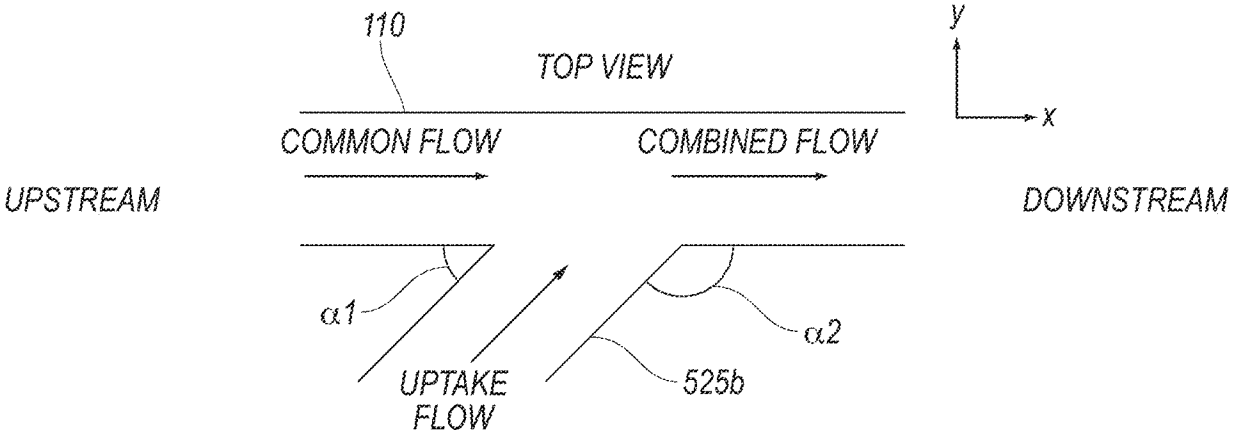
FIG. 5B is a cross-sectional top view of a non-perpendicular interface between an uptake duct and a common tunnel configured in accordance with embodiments of the technology.

FIG. 5B is a cross-sectional top view of a non-perpendicular interface between an uptake duct 525*b* and the common tunnel 110 configured in accordance with embodiments of the technology. The uptake flow from the uptake duct 525*b* intersects the common flow in the common tunnel 110 to form a combined flow. The uptake duct 525*b* and the common tunnel 110 meet at an interface having an upstream angle $\alpha 1$ less than 90° and a downstream angle $\alpha 2$ greater than 90°. The non-perpendicular interface thus provides an azimuthal commonality between the uptake flow vector and the common flow vector. In other words, the uptake flow vector comprises an x-component having a direction in common with an x-component of the common flow vector, and the exhaust gas accordingly loses less momentum at the uptake duct 525*b* and common tunnel 110 interface as compared to the arrangement of FIG. 5A. The reduced momentum loss can lower the draft loss at the interface or, in some embodiments, can even increase the draft in the common tunnel 110.

Figure 5C:
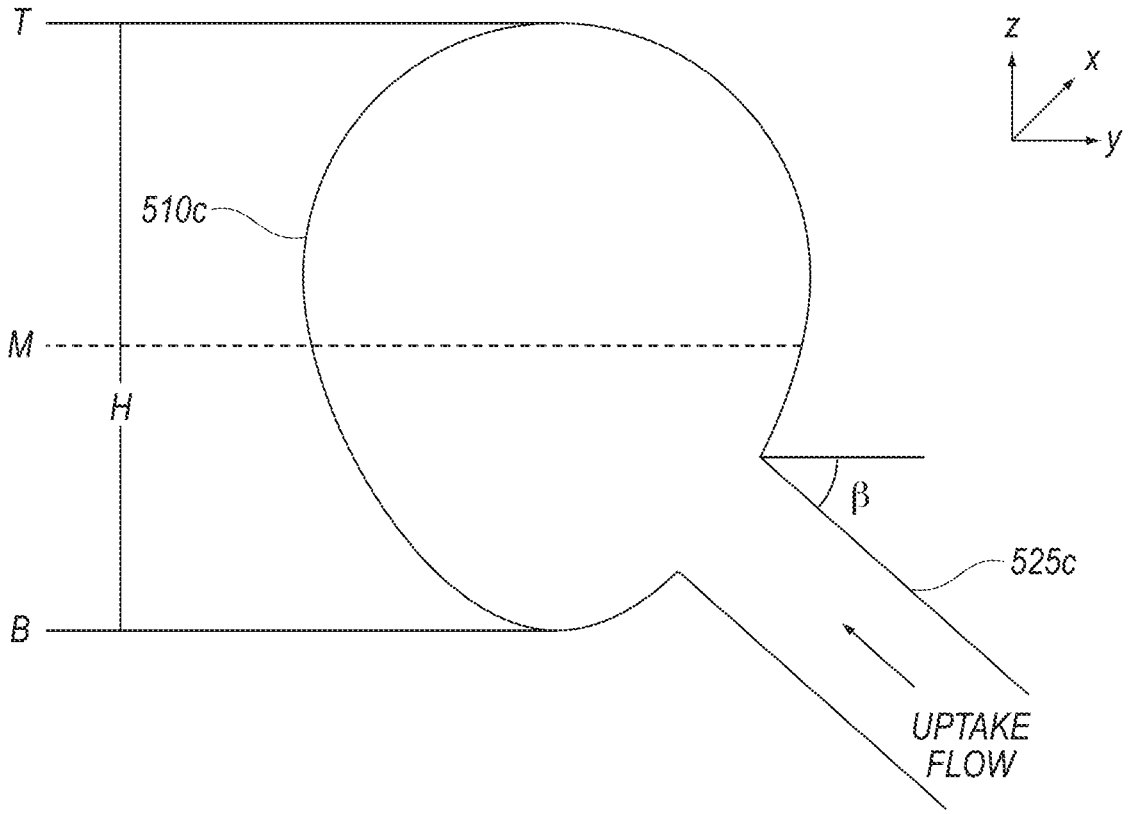
FIG. 5C is a cross-sectional end view of a non-perpendicular interface between an uptake duct and a common tunnel configured in accordance with embodiments of the technology.

FIG. 5C is a cross-sectional end view of a non-perpendicular interface between an uptake duct 525*c* and a common tunnel 510*c* configured in accordance with embodiments of the technology. While previous embodiments have shown the common tunnel to have a generally circular cross-sectional shape, in the embodiment shown in FIG. 5C the common tunnel 510*c* has a generally oval or egg-shaped cross-sectional shape. For example, the common tunnel 510 has a height H between a base B and a top T. In some embodiments, the egg-shaped cross-section can be asymmetrical (i.e., top-heavy), such that the common tunnel 510*c* has a greater cross-sectional area above a midpoint M between the top T and base B than below the midpoint M. Such a top-heavy design can provide for more room in the upper portion of the common tunnel 510*c* for combustion to occur, as the buoyancy of hot exhaust gas tends to urge combustion upward. The oblong shape of the illustrated common tunnel 510*c* can thus minimize flame impingement along the upper surface of the interior of the common tunnel 510*c*. In further embodiments, the uptake duct 525*c* can comprise any of the circular or non-circular cross-sectional shapes described above with reference to the common tunnel 510*c*, and the uptake duct 525*c* and common tunnel 510*c* need not have the same cross-sectional shape.

The uptake flow from the uptake duct 525*c* intersects the common flow in the common tunnel 510*c* to form a combined flow. Again referencing a spherical coordinate system, the uptake duct 525*c* meets the common tunnel 510*c* at an interface having a negative altitude angle $\beta$ less than 90° with respect to the horizon (e.g., with respect to the x-y plane). The non-perpendicular interface thus provides an altitudinal difference between the uptake flow vector and the common flow vector. In other words, the uptake flow vector comprises a z-component that differs from a z-component of the common flow vector. In some embodiments, by introducing the uptake flow into the common flow at an altitudinal angle relative to the common flow vector, swirling flow or turbulence is developed inside the common tunnel 510*c* to enhance mixing and combustion of unburned volatile matter and oxygen. In other embodiments, the altitude angle $\beta$ is a positive angle, greater than 90°, or approximately equal to 90°.

The uptake duct 525*c* can interface with the common tunnel 510*c* at any height between the top T and bottom B of the common tunnel 510*c*. For example, in the illustrated embodiment, the uptake duct 525*c* intersects with the common tunnel 510*c* in the lower portion of the common tunnel 510*c* (i.e., below or substantially below the midpoint M). In further embodiments, the uptake duct 525*c* intersects with the common tunnel 510*c* in the upper portion of the common tunnel 510*c*, at the midpoint M, at a top T or bottom B of the common tunnel 510*c*, or in multiple locations around the cross-sectional circumference of the common tunnel 510*c*. For example, in a particular embodiment, one or more uptake ducts 525*c* may intersect with the common tunnel 510*c* in the lower portion and one or more other uptake ducts 525*c* may intersect with the common tunnel 510*c* in the upper portion.

Figure 5D:
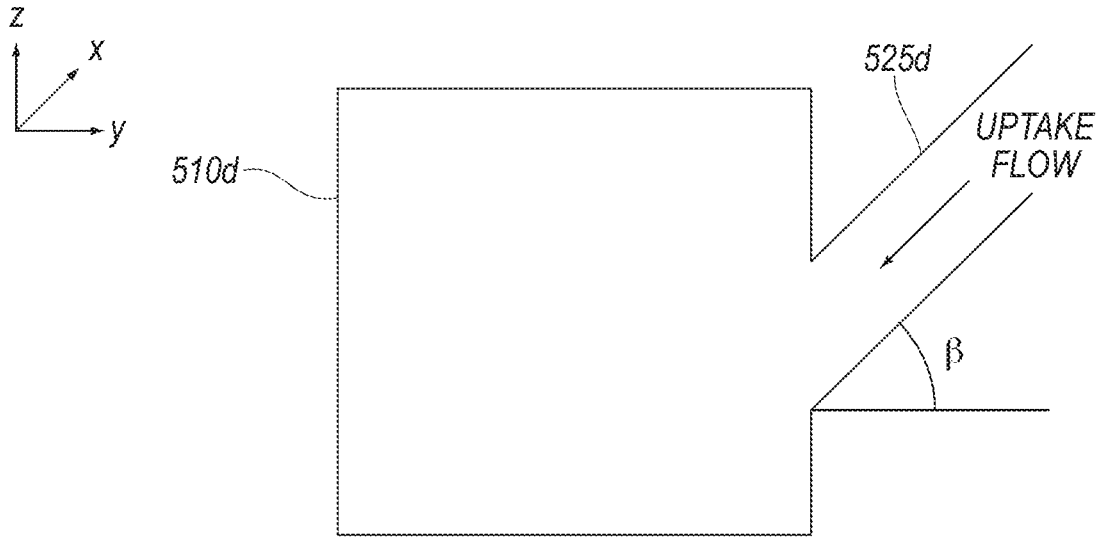
FIG. 5D is a cross-sectional end view of a non-perpendicular interface between an uptake duct and a common tunnel configured in accordance with embodiments of the technology.

FIG. 5D is a cross-sectional end view of a non-perpendicular interface between an uptake duct 525*d* and the common tunnel 510*d* configured in accordance with embodiments of the technology. In the embodiment shown in FIG. 5D the common tunnel 510*d* has a generally square or rectangular cross-sectional shape. Other embodiments can have other cross-sectional shapes. The uptake flow from the uptake duct 525*d* intersects the common flow in the common tunnel 510*d* to form a combined flow. Again referencing a spherical coordinate system, the uptake duct 525*d* and the common tunnel 510*d* meet at an interface having a positive altitude angle $\beta$ less than 90° with respect to the horizon. In other words, the uptake flow vector comprises a z-component that differs from a z-component of the common flow vector. In some embodiments, by introducing the uptake flow into the common flow at an altitudinal angle different from the common flow, mixing draft loss can be reduced and combustion can be encouraged to occur at a height that does not burn the interior surfaces of the common tunnel 510*d*. For example, the downward altitudinal introduction of flow from the uptake duct 525*d* can counter the buoyancy of the hot exhaust gas to encourage combustion to occur toward the bottom of the common tunnel 510*d* so as not to burn the top of the common tunnel 501*d*.

Figure 5E:
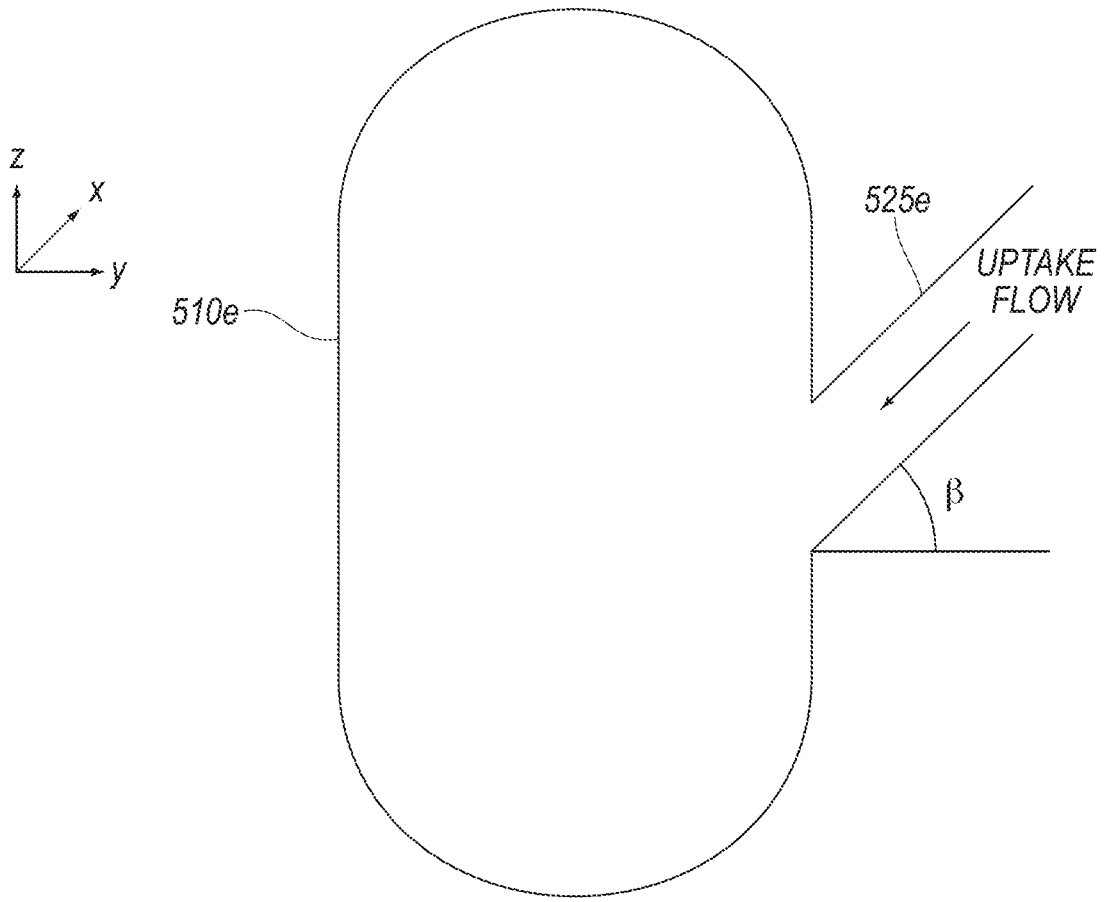
FIG. 5E is a cross-sectional end view of a non-perpendicular interface between an uptake duct and a common tunnel configured in accordance with embodiments of the technology.

FIG. 5E is a cross-sectional end view of a non-perpendicular interface between an uptake duct 525*e* and a common tunnel 510*e* configured in accordance with embodiments of the technology. The interface has several features generally similar to those discussed above with reference to FIGS. 5A-5D. However, in the embodiment illustrated in FIG. 5E, the common tunnel 510*e* comprises a symmetrical, elongated oval. More specifically, the common tunnel 510*e* includes a semi-circular shape at top and bottom positions of the common tunnel 510*e*, and generally straight, parallel, elongated sides between the top and bottom semi-circles. The elongated shape can provide several of the advantages described above. For example, the design can provide for more room in the mid-section of the common tunnel 510*e* for combustion to occur, as the buoyancy of hot exhaust gas tends to urge combustion upward. Similarly, the downward altitudinal introduction of flow from the uptake duct 525*e* at angle β can further counter the buoyancy of the hot exhaust gas to encourage combustion to occur toward the bottom of the common tunnel 510*e*. The oblong shape of the illustrated common tunnel 510*e* can thus minimize flame impingement along the upper surface of the interior of the common tunnel 510*e*. In further embodiments, the common tunnel 510*e* can be symmetrical or asymmetrical and have the same or different shapes.

While various features of the uptake duct and common tunnel interface have been shown separately for purposes of illustration, any of these features can be combined to achieve reduced draft loss, combustion control, and the most effective mixing of the uptake flow and common flow. More specifically, the azimuthal angle of interface, the altitudinal angle of interface, the height of interface, the shape of the common tunnel and/or uptake duct, or other feature can be selected to achieve the desired thermal and draft conditions at the interface. Various parameters such as common tunnel draft, desired degree of common tunnel combustion, exhaust gas buoyancy conditions, total pressure, etc. can be some of the considerations in selecting the features of the uptake duct and common tunnel interface.

FIGS. 6A-6I are top views of various configurations of interfaces between uptake ducts and a common tunnel configured in accordance with embodiments of the technology. As will be shown, the uptake ducts can comprise various patterns of perpendicular and non-perpendicular interfaces with the common tunnel, or can comprise various non-perpendicular angles relative to the common tunnel. While the embodiments shown and discussed with reference to FIGS. 6A-6I include numerous features and arrangements, in further embodiments any of these features and/or arrangements can be used independently or in any combination with other features and/or arrangements described herein.

Figure 6A:
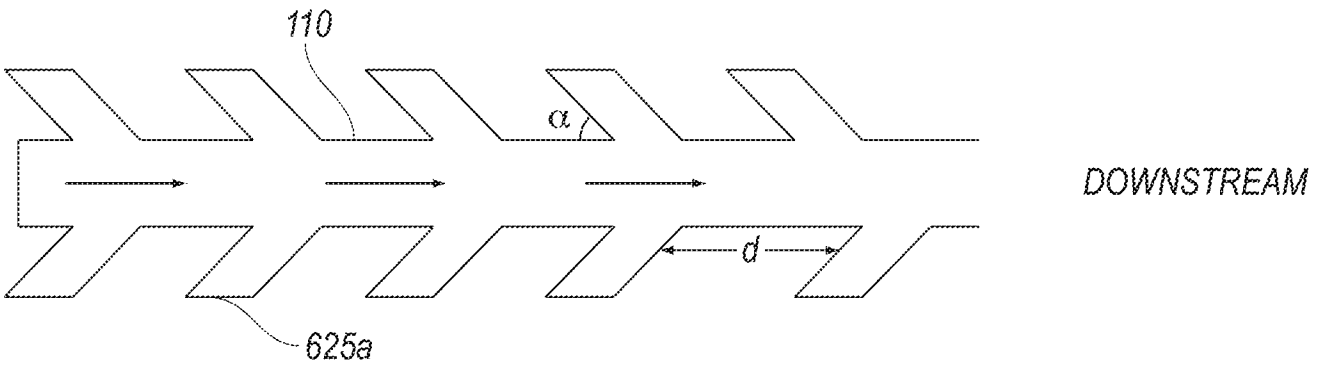
FIGS. 6A-6I are top views of various configurations of interfaces between uptake ducts and a common tunnel configured in accordance with embodiments of the technology.

Referring first to FIG. 6A, in some embodiments each of several uptake ducts 625*a* meets the common tunnel 110 at a less-than-90° upstream angle α. The uptake ducts 625*a* thus reduce mixing loss at the combination of common flow and uptake flow in the manner described above. In some embodiments, corresponding (i.e., opposing) uptake ducts 625*a* are laterally offset from one another and are not directly opposing. This is shown in the two most-downstream uptake ducts 625*a* shown in FIG. 6A. In further embodiments, the spacing between individual uptake ducts 625*a* (i.e., along the length of the common tunnel 110) can likewise be variable. For example, the distance d between the two most downstream uptake ducts 625*a* along one side of the common tunnel 110 is greater than the distance between the other uptake ducts 625*a*. In further embodiments, the spacing is constant between all uptake ducts 625*a*.

Figure 6B:
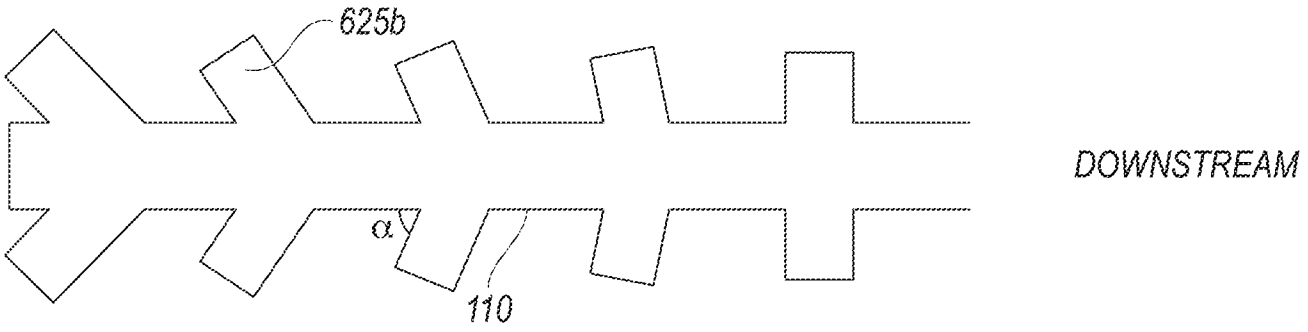

FIG. 6B illustrates an embodiment where uptake ducts 625*b* meet the common tunnel 110 at decreasing upstream angles α. For example, at a most downstream position, the uptake ducts may be perpendicular or nearly-perpendicular to the common tunnel 110. As the uptake tunnels approach an upstream end, the upstream angles α between the uptake ducts 625*b* and the common tunnel 110 become progressively smaller. In some embodiments, the range of upstream angles α varies from about 15° to about 90°. Since the draft pull is weaker farther upstream, this arrangement can progressively reduce the barrier to entry of the uptake flow into the common flow and thereby reduce draft loss due to mixing or stagnant flow regions. In further embodiments, one or more uptake ducts 625*b* can be positioned at an upstream angle α that is greater than 90°. In still further embodiments, the trend shown in FIG. 6B can be reversed. More specifically, the uptake ducts 625*b* can meet the common tunnel 110 at increasing upstream angles, wherein the most-upstream angle can be near or approaching 90°. Such an arrangement can be useful in embodiments where mixing flow losses are potentially greater at downstream positions having higher accumulated common flow.

Figure 6C:
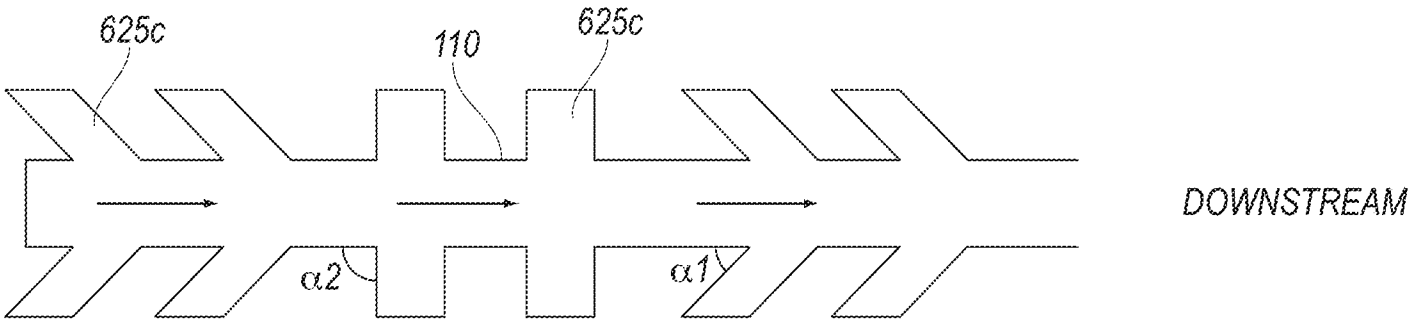

FIG. 6C illustrates an embodiment having a combination of uptake ducts 625*c* meeting the common tunnel 110 at non-perpendicular angles α1 and perpendicular angles α2. The illustrated embodiment includes pairs of non-perpendicular ducts 625*c* along a side of the common tunnel 110 followed by pairs of perpendicular ducts 625*c*, and so on. In further embodiments, there can be more or fewer perpendicular or non-perpendicular uptake ducts 625*c* in a row.

Figure 6D:
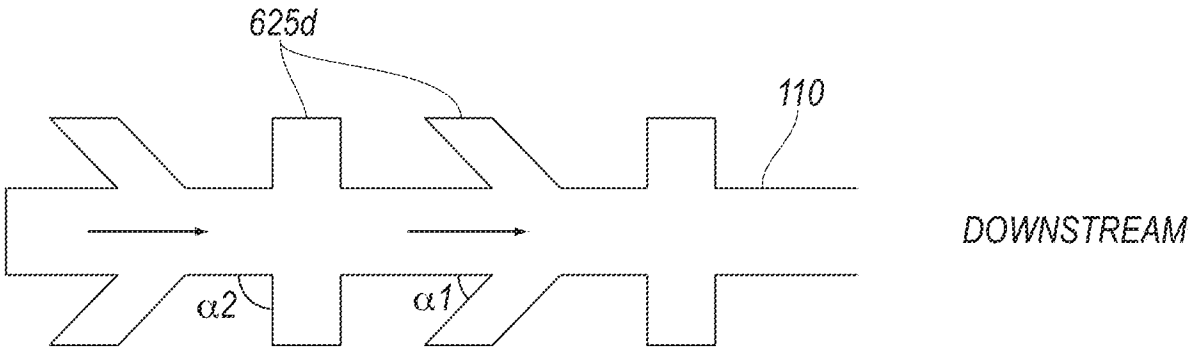

FIG. 6D illustrates an embodiment having a combination of uptake ducts 625*d* meeting the common tunnel 110 at non-perpendicular angles α1 and perpendicular angles α2. The illustrated embodiment includes alternating non-perpendicular ducts 625*d* and perpendicular ducts 625*d* along a side of the common tunnel 110.

Figure 6E:
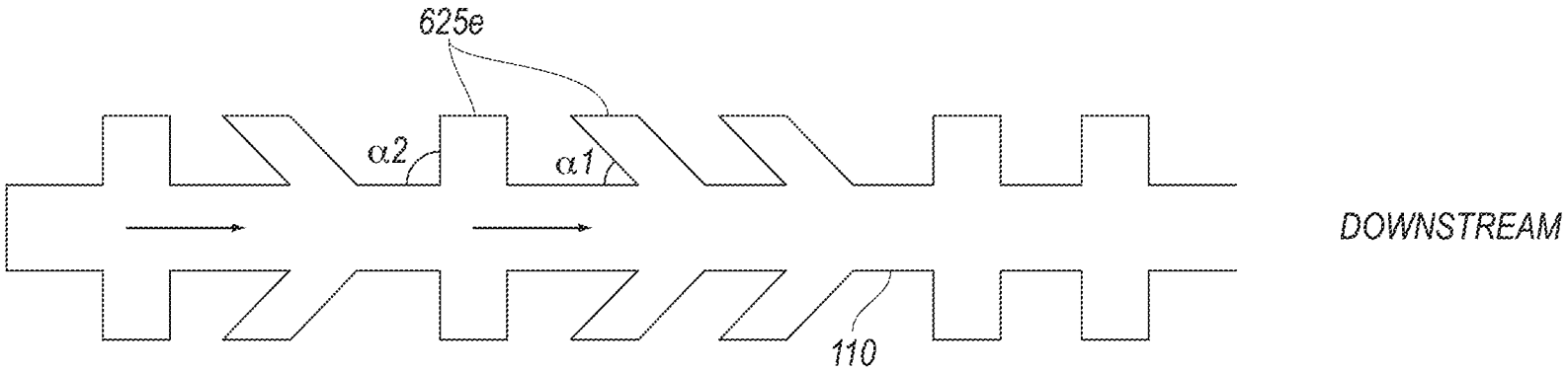

FIG. 6E illustrates an embodiment having a combination of uptake ducts 625*e* meeting the common tunnel 110 at non-perpendicular angles αl and perpendicular angles α2. The illustrated embodiment includes individual perpendicular uptake ducts 625*e* alternating with non-perpendicular uptake ducts 625*e*, followed by pairs of non-perpendicular ducts 625*e*, followed by pairs of perpendicular ducts 625*e*, and so on. This pattern or a portion of this pattern can repeat along further sections of the common tunnel 110. In further embodiments, there can be different combinations of perpendicular and non-perpendicular uptake ducts.

Figure 6F:
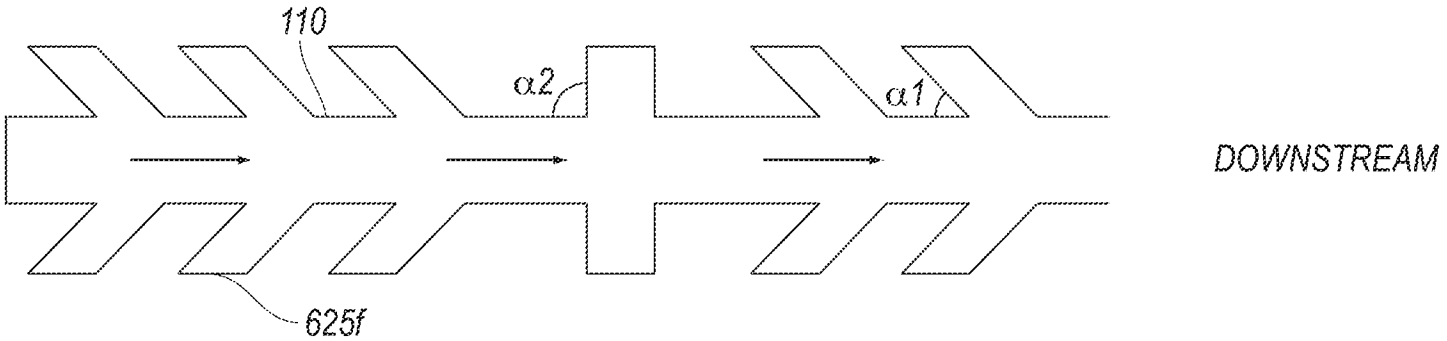

FIG. 6F illustrates an embodiment having a combination of uptake ducts 625*f* meeting the common tunnel 110 at non-perpendicular angles αl and perpendicular angles α2. The illustrated embodiment includes a series of non-perpendicular uptake ducts 625*f*, followed by a perpendicular duct 625*f*, followed by another series of non-perpendicular ducts 625*f*, and so on.

Figure 6G:
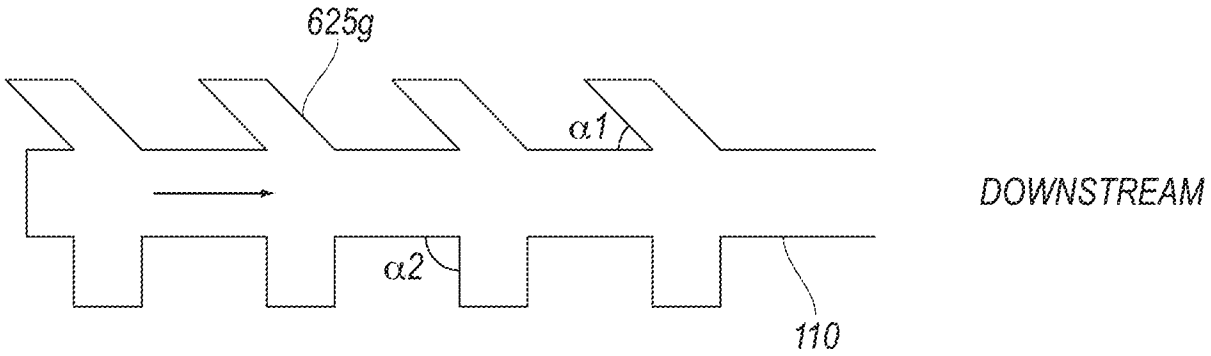

FIG. 6G illustrates an embodiment having a combination of uptake ducts 625*g* meeting the common tunnel 110 at non-perpendicular angles αl and perpendicular angles α2. The illustrated embodiment includes non-perpendicular uptake ducts 625*g* on a first lateral side of the common tunnel 110, and perpendicular ducts 625*g* along a second, opposing, lateral side of the common tunnel 110.

Figure 6H:
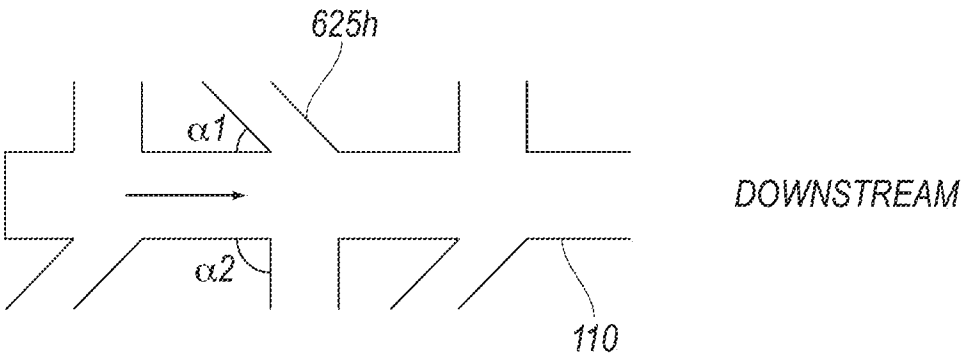

FIG. 6H illustrates an embodiment having a combination of uptake ducts 625*h* meeting the common tunnel 110 at non-perpendicular angles αl and perpendicular angles α2. The illustrated embodiment includes alternating non-perpendicular ducts 625*h* and perpendicular ducts 625*h* along a side of the common tunnel 110, where the non-perpendicular uptake ducts 625*h* are opposite perpendicular ducts 625*h* and vice-versa.

Figure 6I:
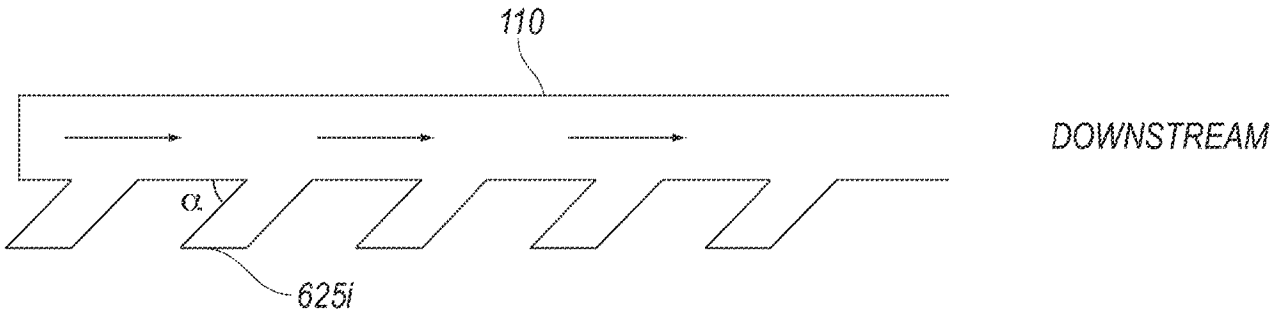

FIG. 6I illustrates an embodiment having uptake ducts 625*i* along only one lateral side of the common tunnel 110, with no uptake ducts on the opposing lateral side. In some embodiments, two single-sided common tunnels 110 can be operated in a coke plant in a side-by-side parallel arrangement. The uptake ducts 625*i* can be angled at non-perpendicular angle α relative to the common tunnel 110 in the manner described above.

Figure 7A:
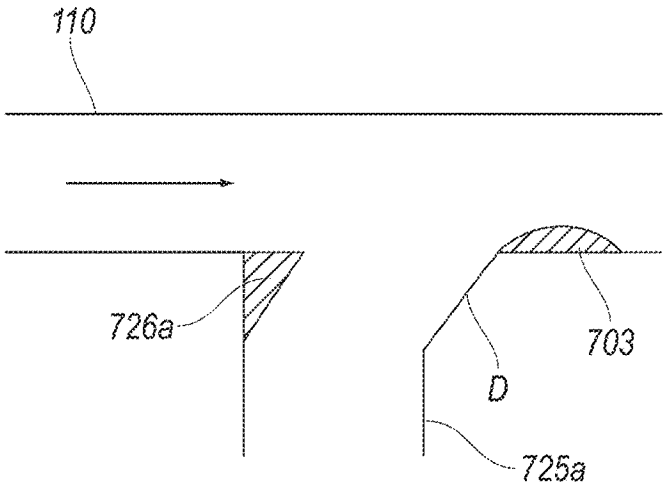
FIG. 7A is a cross-sectional top view of a non-perpendicular interface retrofitted between an uptake and a common tunnel configured in accordance with embodiments of the technology.

FIG. 7A is a cross-sectional top view of a non-perpendicular interface retrofitted between a perpendicular uptake duct 725*a* and the common tunnel 110 configured in accordance with embodiments of the technology. The uptake duct 725*a* and the common tunnel 110 can originally have the same arrangement as the embodiment discussed above with reference to FIG. 5A, but can be retrofitted to include one or more non-perpendicular interface features. For example, the interface has been fitted with an internal baffle 726*a* to alter the flow pattern and create a non-perpendicular interface. More specifically, the baffle 726*a* is placed in a lumen of the uptake duct 725*a* and modifies a perpendicular interface into an angled interface that reduces draft loss due to mixing. In the illustrated embodiment, the baffle 726*a* is triangle-shaped and converges the uptake flow by reducing an inner characteristic dimension of the uptake duct 725*a*. This converged flow can act as a nozzle and minimize flow energy losses of the uptake flow and/or common flow. In further embodiments, the baffle 726*a* can be adjustable (i.e., movable to adjust the flow and interface pattern), can have different shapes and/or sizes, and/or can converge and/or diverge flow to other degrees. Further, the baffle can extend around more or less of the lumen of the uptake duct 725*a*.

The common tunnel 110 can further be retrofitted with a flow modifier 703 positioned on an interior surface of the common tunnel 110 and configured to interrupt or otherwise modify flow in the common tunnel 110, or improve the interface (i.e., reduce draft loss) at the junction of the uptake flow and the common flow. The uptake duct 725*a* has further been modified with a bumped-out diverging flow plate D. The diverging flow plate D modifies the uptake flow vector to have an x-component in common with a common flow vector, thus reducing draft loss between the uptake flow and the common flow. While the diverging flow plate D, the baffle 726*a*, and the flow modifier 703 are shown in use together, in further embodiments, any of these features can be used independently or in any combination with any other features described herein.

While the terms "baffle" 726*a* and "flow modifier" 703 are used herein, the additions to the uptake duct 726*a* or common tunnel 110 can comprise any insulation material, refractory material, or other thermally-suitable material. In some embodiments, the flow modifier 703 and/or baffle 726*a* may comprise a single or multilayer lining that is built up with a relatively inexpensive material and covered with a skin. In yet another embodiment, refractory or similar material can be shaped via gunning (i.e. spraying). Better control of shaping via gunning may be accomplished by gunning in small increments or layers. In addition, a template or mold may be used to aid the shaping via gunning. A template, mold, or advanced cutting techniques may be used to shape the refractory (e.g. even in the absence of gunning for the main shape of an internal insert) for insertion into the duct and then attached via gunning to the inner lining of the duct. In yet another embodiment, the flow modifier 703 and/or baffle 726*a* may be integrally formed along the duct. In other words, the uptake duct 725*a* wall may be formed or "dented" to provide a convex surface along the interior surface of the duct. As used herein, the term convex does not require a continuous smooth surface, although a smooth surface may be desirable. For example, the flow modifier 703 and/or baffle 726*a* may be in the form of a multi-faceted protrusion extending into the flow path. Such a protrusion may be comprised of multiple discontinuous panels and/or surfaces. Furthermore, the flow modifier 703 and/or baffle 726*a* are not limited to convex surfaces. The contours of the flow modifier 703 and/or baffle 726*a* may have other complex surfaces, and can be determined by design considerations such as cost, space, operating conditions, etc. In further embodiments, there can be more than one flow modifier 703 and/or baffle 726*a*. Further, while the flow modifier 703 is shown in the common tunnel 110, in further embodiments the flow modifier 703 can be positioned at other locations (e.g., entirely or partially extending into the uptake duct 725*a*, or around the inner circumference of the common tunnel 110.

Figure 7B:
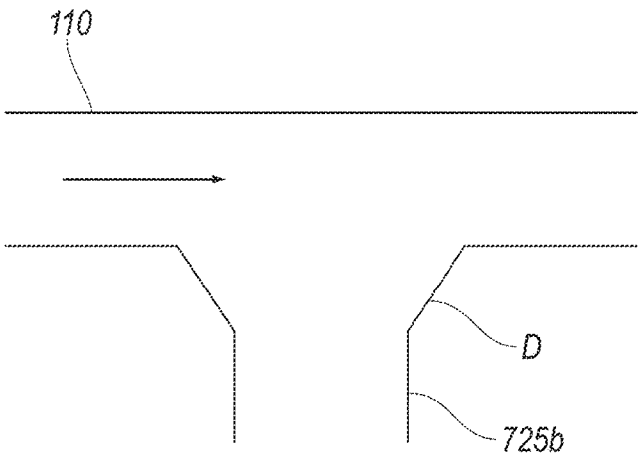
FIG. 7B is a cross-sectional top view of an interface between an uptake and a common tunnel configured in accordance with embodiments of the technology.
Figure 7C:
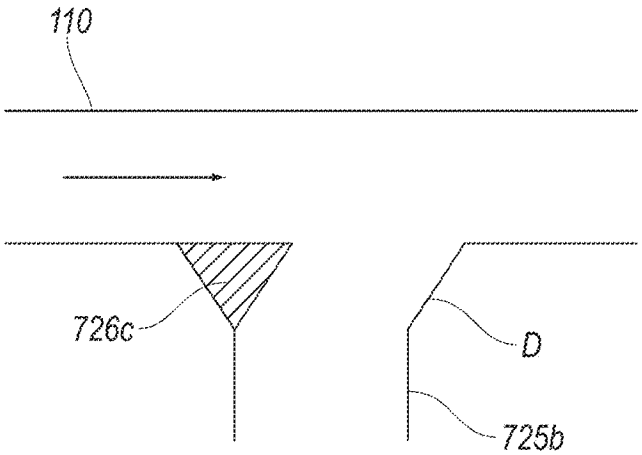
FIG. 7C is a cross-sectional top view of a non-perpendicular interface retrofitted between the uptake and common tunnel of FIG. 7B configured in accordance with embodiments of the technology.

FIG. 7B is a cross-sectional top view of an interface between an uptake duct 725*b* and a common tunnel 110 configured in accordance with embodiments of the technology. FIG. 7C is a cross-sectional top view of a non-perpendicular interface retrofitted between the uptake duct 725*b* and common tunnel 110 of FIG. 7B. Referring to FIGS. 7B and 7C together, the uptake duct 725*b* includes a diverging uptake end D that flares at the interface with the common tunnel 110. The uptake duct 725*b* can be retrofitted with an internal baffle 726*c* generally similar to the internal baffle 726*a* described above with reference to FIG. 7A. The internal baffle 726*c* of FIG. 7C can eliminate the flare or a portion of the flare at the diverging end D, to create a non-perpendicular interface between the uptake duct 725*b* and the common tunnel 110 to reduce draft loss. In further embodiments, the entire internal circumference of the uptake duct 725*b* can be fitted with the baffle 726*c* to further narrow or otherwise alter the interface. The baffle 726*c* can minimize flow energy losses as the uptake flow meets the common flow in the common tunnel 110.

Figure 8:
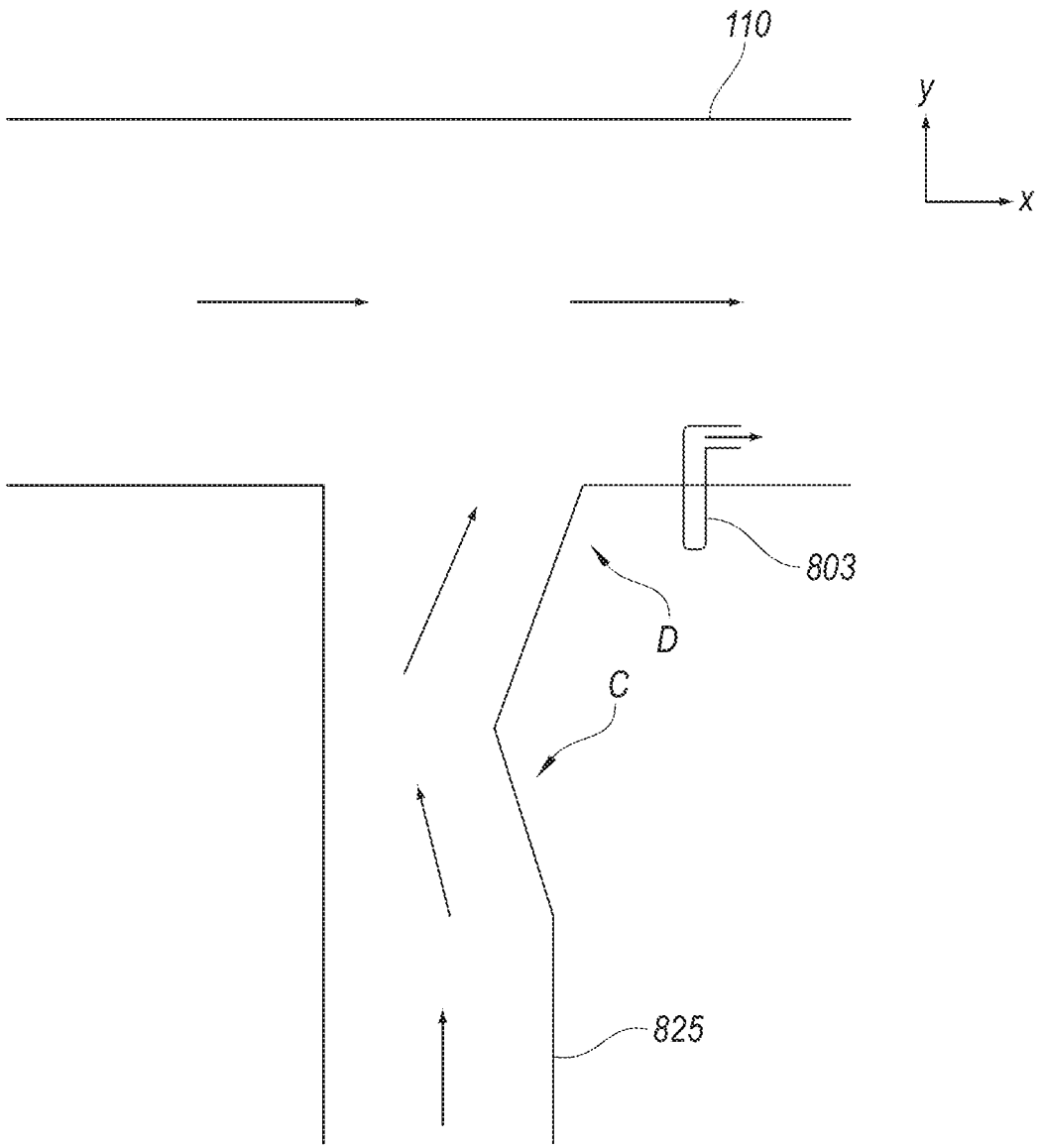
FIG. 8 is a cross-sectional top view of a non-perpendicular interface between an uptake and a common tunnel configured in accordance with embodiments of the technology.

FIG. 8 is a cross-sectional top view of a non-perpendicular interface between an uptake duct 825 and the common tunnel 110 configured in accordance with embodiments of the technology. The uptake duct 825 includes a converging portion C followed by a diverging portion D. The converging portion C can minimize flow energy losses as the exhaust gas from the uptake duct 825 meets the common flow in the common tunnel 110. The diverging portion provides an interface that modifies the uptake flow vector to have an x-component in common with a common flow vector, thus reducing draft loss between the pressurized uptake flow and the common flow. In various embodiments, the diverging and converging portions can have smooth or sharp transitions, and there can be more or fewer converging or diverging nozzles in the uptake duct 825 or common tunnel 110. In another embodiment, the converging portion C is adjacent to the common tunnel 110 and the diverging portion D is upstream in the uptake duct 825. In further embodiments, the converging portion C can be used independently from the diverging portion D, and vice versa.

The interface of FIG. 8 further includes a jet 803 configured to introduce a pressurized fluid such as air, exhaust gas, water, steam, fuel, oxidizer, inert, or other fluid (or combination of fluids) to the uptake flow or common flow as a way to improve flow and reduce draft loss. The fluid can be gaseous, liquid, or multiphase. The jet 803 can stem from or be supported by any external or internal pressurized source (e.g., a pressurized vessel, a pressurized line, a compressor, a chemical reaction or burning within the coking oven system that supports energy to create pressure, etc.). While the jet 803 is shown as penetrating the common tunnel 110 at a position downstream of the uptake duct 825, in further embodiments the jet 803 can be positioned in the uptake duct 825, upstream of the uptake duct 825 in the common tunnel 110, in multiple locations (e.g., a ring) around the circumference of the common tunnel 110 or uptake duct 825*a*, a combination of these positions, or other positions. In a particular embodiment, the jet 803 can be positioned in the uptake duct 825 upstream of the converging portion C. The jet 803 can act as an ejector, and can pull a vacuum draft behind the pressurized fluid. The jet 803 can thus modify flow to create improved draft conditions, energize flow or mixing, or can reduce stagnant air or "dead" zones. In various embodiments, the jet 803 can pulse the fluid, provide constant fluid, or be run on a timer. Further, the jet 803 can be controlled manually, in response to conditions in the common tunnel 110, uptake duct 825, or other portion of the exhaust system, or as part of an advanced control regime. While the jet 803 is shown in use with the particular uptake duct 825 arrangement illustrated in FIG. 8, in further embodiments, the jet 803 and uptake duct 825 could be employed independently or in any combination with any other features described herein. For example, in a particular embodiment, the jet 803 could be used in combination with the flow modifier 703 shown in FIG. 7A, and could be proximate to or protrude through such a flow modifier 703.

Figure 9:
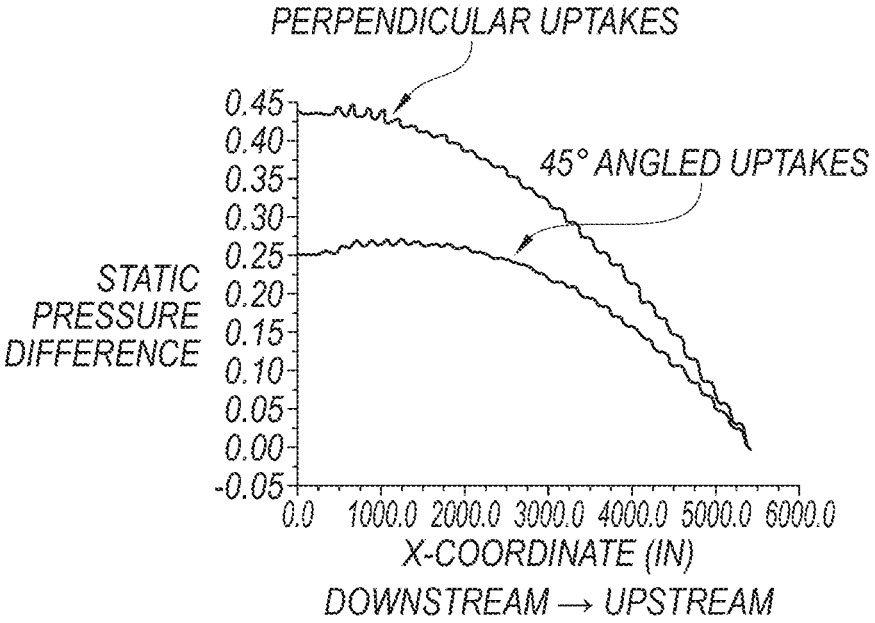
FIG. 9 is a plot showing the spatial distribution of gas static pressure along the length of the common tunnel.

FIG. 9 is a plot showing the spatial distribution of the difference in static pressure (in inches-water) along the length of the common tunnel. In other words, the plot illustrates the difference in static pressure at downstream positions in the common tunnel compared to the static pressure at the upstream end. As shown in the plot, the 45 degree uptake has a much lower draft loss over the same length of common tunnel as compared to the perpendicular uptake. This is because the angled uptake has less mixing loss than the perpendicular uptake.

EXAMPLES

The following Examples are illustrative of several embodiments of the present technology.

1. A coking system, comprising:
   - a coke oven;
   - an uptake duct in fluid communication with the coke oven and having an uptake flow vector of exhaust gas from the coke oven; and
   - a common tunnel in fluid communication with the uptake duct, the common tunnel having a common flow vector of exhaust gas and configured to transfer the exhaust gas to a venting system, wherein the uptake flow vector and common flow vector meet at a non-perpendicular interface.

2. The coking system of example 1 wherein at least a portion of the uptake duct is non-perpendicular to the common tunnel.

3. The coking system of example 1 wherein the non-perpendicular interface comprises at least one of an altitudinal difference or an azimuthal commonality between the uptake flow vector and the common flow vector.

4. The coking system of example 1 wherein the common tunnel has a common tunnel height, an upper portion above a midpoint of the common tunnel height, and a lower portion below the midpoint of the common tunnel height, and wherein the uptake duct interfaces with the common tunnel in at least one of the upper portion and the lower portion.

5. The coking system of example 1 wherein the non-perpendicular interface comprises at least one of a baffle, gunned surface, contoured duct liner, or convex flow modifier inside at least one of the uptake duct or common tunnel and configured to alter at least one of the uptake flow vector or common flow vector.

6. The coking system of example 5 wherein the baffle, gunned surface, contoured duct liner, or convex flow modifier is integral to at least one of the uptake duct or common tunnel or is retrofitted onto the uptake duct or common tunnel.

7. The coking system of example 1 wherein at least one of the uptake duct or the interface comprises a converging or diverging pathway.

8. The coking system of example 1 wherein the uptake duct comprises a first uptake duct in fluid communication with a first coke oven and having a first uptake flow vector, and wherein the system further comprises a second uptake duct in fluid communication with the first coke oven or a second coke oven and having a second uptake flow vector of exhaust gas.

9. The coking system of example 8 wherein the first uptake flow vector and common flow vector meet at a non-perpendicular interface, and the second uptake flow vector and common flow vector meet at a perpendicular interface.

10. The coking system of example 8 wherein the first uptake flow vector and common flow vector meet at a non-perpendicular interface and the second uptake flow vector and common flow vector meet at a non-perpendicular interface.

11. The coking system of example 8 wherein at least a portion of the first uptake duct is non-perpendicular to the common tunnel by a first angle and at least a portion of the second uptake duct is non-perpendicular to the common tunnel by a second angle different from the first angle.

12. The coking system of example 8 wherein:
   - the system further comprises a third uptake duct in fluid communication with the first coke oven, the second coke oven, or a third coke oven and having a third uptake flow vector of exhaust gas;
   - the first uptake duct, second uptake duct, and third uptake duct are positioned along a lateral side of the common tunnel; and
   - there is a first distance between the first uptake duct and second uptake duct and a second distance different from the first distance between the second uptake duct and the third uptake duct.

13. The coking system of example 8 wherein the first uptake duct is positioned on a first lateral side of the common tunnel and the second uptake duct is positioned on a second lateral side of the common tunnel opposite the first lateral side, and wherein the first uptake duct and second uptake duct are laterally offset from one another.

14. The coking system of example 8 wherein the first uptake duct and second uptake duct are positioned on a common lateral side of the common tunnel, and wherein there are no uptake ducts on an opposing lateral side of the common tunnel.

15. The coking system of example 1 wherein the common tunnel has one of a circular, non-circular, oval, elongated oval, asymmetrical oval, or rectangular cross-sectional shape.

16. A method of reducing draft losses in a common tunnel in a coking system, the method comprising:
   - flowing exhaust gas from a coke oven through an uptake duct;
   - biasing the exhaust gas exiting the uptake duct toward a common flow in the common tunnel; and
   - merging the exhaust gas and common flow at a non-perpendicular interface.

17. The method of example 16, further comprising at least one of converging or diverging the exhaust gas in or upon exiting the uptake duct.

18. The method of example 16 wherein biasing the exhaust gas comprises biasing the exhaust gas with a baffle in the uptake duct.

19. The method of example 16, further comprising increasing a draft in the common tunnel upon merging the exhaust gas and common flow.

20. The method of example 16 wherein biasing the exhaust gas comprises biasing the exhaust gas within the uptake duct, wherein the uptake duct is at least partially non-perpendicular to the common tunnel.

21. The method of example 16, further comprising introducing a pressurized fluid via a jet into at least one of the uptake duct or the common tunnel.

22. A coking system, comprising:

a common tunnel configured to direct a gas from one or more coke ovens to a common stack, wherein the common tunnel has a common tunnel flow with a common tunnel flow vector, and wherein the common tunnel flow vector has an x-component and a y-component;

a coke oven in fluid connection with the common tunnel via an uptake, wherein— the uptake connects to the common tunnel at an intersection, and the uptake includes an uptake flow having an uptake flow vector with an x-component and a y-component; and wherein the uptake flow vector x-component has a same direction as the x-component of the common tunnel flow vector.

23. The coking system of example 22 wherein an inner characteristic dimension of the uptake at least one of increases or decreases in the direction of the intersection.

24. The coking system of example 22 wherein the uptake further includes an angled baffle at or near the intersection, the baffle configured to redirect the uptake flow.

Traditional heat recovery coke ovens employ an uptake duct connection from the coke oven to the hot common tunnel that is perpendicular to the common tunnel. Due to the perpendicular shape of the interface, the hot flue gas moving toward the common tunnel experiences a 90-degree change in flow direction. This induces considerable flow losses which can lead to a higher pressure drop. Such mixing losses are undesirable. In order to maintain the system under negative pressure, the high draft loss may require that either the common tunnel be made larger or a higher draft be pulled on the whole system to off-set this higher draft loss.

The non-perpendicular interfaces disclosed herein can lower the mixing draft loss at the uptake/common tunnel connection by angling the connection in the direction of the common tunnel flow. The smaller the upstream angle between the uptake duct and the common tunnel, the lesser the change in the directional momentum of the hot gas and, consequently, the lower the draft losses. By using non-perpendicular interfaces and aligning the uptake duct flow in the direction of the common tunnel flow, the draft loss can be lowered, which then can be used to reduce the common tunnel size or lower the required draft. For example, in some embodiments, the technology described herein can reduce the common tunnel insider diameter to 7-9 feet. The technology could similarly allow a longer common tunnel that would traditionally have been prohibitive due to draft losses. For example, in some embodiments, the common tunnel can be long enough to support 30, 45, 60, or more ovens per side.

From the foregoing it will be appreciated that, although specific embodiments of the technology have been described herein for purposes of illustration, various modifications may be made without deviating from the spirit and scope of the technology. Further, certain aspects of the new technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. Thus, the disclosure is not limited except as by the appended claims.

We claim:

1. A coking system, comprising:

a common tunnel configured to direct a gas from one or more coke ovens to a common stack, wherein the common tunnel has a common tunnel flow with a common tunnel flow vector, and wherein the common tunnel flow vector, on a spherical coordinate system having an x-axis, y-axis, and z-axis, has an x-component extending along a long axis of the common tunnel, a y-component extending along a width of the common tunnel, and a z-component extending along a height of the common tunnel;

a coke oven in fluid connection with the common tunnel via an uptake, wherein:

the uptake connects to the common tunnel at an intersection;

the uptake includes an uptake flow having an uptake flow vector, at the intersection, with an x-component, a y-component, and a z-component on the spherical coordinate system; and wherein the uptake is disposed at an angle with respect to the common tunnel, at the intersection, such that the uptake flow vector x-component has a direction in common with of the common flow vector x-component but the uptake flow vector z-component differs from the z-component of the common tunnel flow vector, thereby encouraging mixing and combustion of unburned volatile material and oxygen inside the common tunnel.

2. The coking system of claim 1 wherein an inner characteristic dimension of the uptake at least one of increases or decreases in the direction of the intersection.

3. The coking system of claim 1 wherein the uptake further includes an angled baffle at or near the intersection, the baffle configured to redirect the uptake flow.

4. The coking system of claim 1 wherein the common tunnel has an elliptical cross-sectional shape.

5. The coking system of claim 1 wherein the z-component of the uptake flow vector is in a downward direction, such that buoyancy of gases exiting the uptake are at least partially countered and combustion of the gases is encouraged to occur toward a lower portion of the common tunnel.

* * * * *